US008365941B2

(12) United States Patent
Mayer

(10) Patent No.: US 8,365,941 B2
(45) Date of Patent: Feb. 5, 2013

(54) DUAL-CAPPED HYDRATION BOTTLE

(75) Inventor: David James Mayer, Portola Valley, CA (US)

(73) Assignee: David James Mayer, Portola Valley, CA (US)

( * ) Notice: Subject to any disclaimer, the term of this patent is extended or adjusted under 35 U.S.C. 154(b) by 679 days.

(21) Appl. No.: 12/467,205

(22) Filed: May 15, 2009

(65) Prior Publication Data

US 2010/0288723 A1 Nov. 18, 2010

(51) Int. Cl.
*B65D 43/06* (2006.01)

(52) U.S. Cl. ..... 220/259.3; 206/217; 215/6; 215/276; 220/254.7; 220/259.4; 220/319; 220/4.26; 220/916

(58) Field of Classification Search ..... 206/217, 206/218, 499; 215/2, 6, 10, 11.6, 12.1, 274, 215/276, 277, DIG. 7; 220/4.26, 4.27, 23.87–23.89, 220/23.91, 256.1, 259.3, 259.4, 319, 320, 220/459.03, 459.05, 503, 504, 523, 524, 220/526, 592.17, 739, 740, 916, 254.7
See application file for complete search history.

(56) References Cited

U.S. PATENT DOCUMENTS

| | | | | | |
|---|---|---|---|---|---|
| 880,082 | A | * | 2/1908 | Kendrick | 215/6 |
| 1,351,496 | A | * | 8/1920 | Spooner | 215/329 |
| 2,113,848 | A | * | 4/1938 | Lui | 215/12.1 |
| 2,204,784 | A | * | 6/1940 | Abrams | 312/31.2 |
| 2,326,414 | A | * | 8/1943 | Thompson | 220/4.27 |
| 2,663,450 | A | * | 12/1953 | Bourcart | 220/522 |
| 2,765,950 | A | * | 10/1956 | Wheeler | 220/290 |
| 2,836,323 | A | * | 5/1958 | Robinson | 220/4.27 |
| 2,837,232 | A | * | 6/1958 | Rossi | 215/13.1 |
| 2,843,281 | A | * | 7/1958 | Gallois | 215/11.1 |
| 3,134,494 | A | * | 5/1964 | Quinn | 215/11.3 |
| 3,308,980 | A | * | 3/1967 | Taylor | 215/13.1 |
| 3,804,281 | A | * | 4/1974 | Eckdahl | 215/12.1 |
| 3,810,367 | A | * | 5/1974 | Peterson | 435/1.1 |
| 3,856,138 | A | * | 12/1974 | Maekawa et al. | 206/221 |
| 4,006,835 | A | * | 2/1977 | Cummings | 215/12.1 |

(Continued)

FOREIGN PATENT DOCUMENTS

| | | | |
|---|---|---|---|
| GB | 2448549 | A * | 10/2008 |
| WO | WO 0012179 | A1 * | 3/2000 |

OTHER PUBLICATIONS

Nalgene Outdoor, "32oz. Wide Mouth Gray-Everyday", May 15, 2009, <http://www.nalgene-outdoor.com/store/detail.aspx?ID=1240>.

(Continued)

*Primary Examiner* — J. Gregory Pickett
*Assistant Examiner* — Ned A Walker
(74) *Attorney, Agent, or Firm* — Kokka & Backus, PC

(57) ABSTRACT

A hydration bottle is described, including a body having a top neck and a bottom neck disposed at either end of the body, the top neck, the bottom neck, and the body being formed from a continuous mold of material, the top neck and the bottom neck having threads configured to engage thread channels, a top closure having a thread channel disposed about an inner surface of the top closure and configured to engage the threads disposed about the top neck, the top closure also having a nozzle shaft and a nozzle well configured to receive a nozzle, and a bottom closure having another thread channel configured to engage another thread about the bottom neck, the bottom closure having a groove configured to receive a gasket, the groove and the gasket being configured to provide a seal between the bottom closure and the body.

15 Claims, 21 Drawing Sheets

U.S. PATENT DOCUMENTS 4,078,686 A * 3/1978 Karesh ..... 215/6
4,190,173 A * 2/1980 Mason et al. ..... 220/203.05
4,362,443 A * 12/1982 Mallory et al. ..... 406/188
4,429,786 A * 2/1984 Hucal ..... 206/5.1
4,444,324 A * 4/1984 Grenell ..... 215/6
4,466,547 A * 8/1984 Klittich ..... 215/11.3
4,533,057 A * 8/1985 Klittich ..... 215/11.3
4,545,491 A * 10/1985 Bisgaard et al. ..... 215/11.5
4,570,454 A * 2/1986 Campbell ..... 62/457.3
4,591,066 A * 5/1986 Moen ..... 220/634
4,600,111 A * 7/1986 Brown ..... 215/6
4,700,856 A * 10/1987 Campbell et al. ..... 215/11.3
4,823,974 A * 4/1989 Crosser ..... 62/457.3
4,850,496 A * 7/1989 Rudell et al. ..... 215/12.1
4,961,324 A * 10/1990 Allan ..... 62/400
5,038,948 A * 8/1991 Signorini ..... 215/11.1
5,040,719 A * 8/1991 Ballway ..... 220/738
5,086,926 A * 2/1992 Paige et al. ..... 206/542
5,261,554 A * 11/1993 Forbes ..... 220/592.16
5,269,426 A * 12/1993 Morano ..... 215/11.6
5,282,541 A * 2/1994 Chen ..... 215/229
5,335,809 A * 8/1994 Toida et al. ..... 220/592.27
5,353,964 A * 10/1994 Liu et al. ..... 222/134
5,422,129 A * 6/1995 Draddy ..... 426/115
5,472,120 A * 12/1995 Stebick et al. ..... 222/153.06
5,513,762 A * 5/1996 Janani ..... 215/229
5,531,353 A * 7/1996 Ward et al. ..... 220/729
5,542,922 A * 8/1996 Petterson et al. ..... 604/77
5,555,746 A * 9/1996 Thompson ..... 62/457.4
5,653,124 A * 8/1997 Weber ..... 62/457.4
5,829,607 A 11/1998 Ibrahim
5,904,267 A * 5/1999 Thompson ..... 220/592.16
D410,548 S 6/1999 Chomik
5,927,565 A * 7/1999 Paczonay ..... 222/484
5,938,053 A * 8/1999 Verbovszky et al. ..... 215/6
5,950,689 A * 9/1999 Varlet ..... 141/22
5,987,913 A * 11/1999 Andrzejczak ..... 62/457.2
6,010,034 A * 1/2000 Walthers ..... 222/135
6,113,257 A * 9/2000 Sharon et al. ..... 366/130
6,145,685 A * 11/2000 Dick ..... 220/23.88
6,155,452 A * 12/2000 Laurent ..... 220/739
6,179,146 B1 * 1/2001 Betras ..... 220/23.4
6,311,865 B1 * 11/2001 Laurent ..... 220/739
6,415,937 B1 * 7/2002 DeJong et al. ..... 215/386
6,616,000 B1 * 9/2003 Renz ..... 215/11.1
6,616,319 B2 * 9/2003 Renz ..... 366/130
6,684,814 B1 * 2/2004 Ver Hage ..... 119/72
6,719,159 B2 * 4/2004 Chomik ..... 215/343
6,736,285 B2 * 5/2004 Stewart-Stand ..... 220/666
6,786,179 B2 * 9/2004 Ver Hage ..... 119/72
6,915,920 B2 * 7/2005 Hwang et al. ..... 215/358
7,036,975 B2 * 5/2006 Renz ..... 366/130
7,051,907 B2 * 5/2006 Brincat ..... 222/568
7,156,264 B2 * 1/2007 Ver Hage ..... 222/464.1
7,284,677 B2 * 10/2007 Guevara ..... 220/737
7,299,939 B2 * 11/2007 Ver Hage ..... 222/388
7,320,410 B2 * 1/2008 Ver Hage ..... 222/388
7,331,478 B2 * 2/2008 Aljadi ..... 215/11.4
7,380,685 B2 * 6/2008 Simmons et al. ..... 220/703
7,624,701 B2 * 12/2009 Ver Hage ..... 119/72
7,632,457 B2 * 12/2009 Calvert et al. ..... 422/1
7,658,294 B2 * 2/2010 Housley et al. ..... 215/12.1
7,810,348 B2 * 10/2010 Shewchuk ..... 62/457.3
8,113,364 B1 * 2/2012 Asadi ..... 215/6
2003/0097994 A1 * 5/2003 Ver Hage ..... 119/72
2005/0236440 A1 * 10/2005 Cho ..... 222/519
2006/0102628 A1 * 5/2006 Hage ..... 220/254.6
2007/0175852 A1 * 8/2007 Hage ..... 215/229
2008/0035646 A1 * 2/2008 Smith ..... 220/526
2009/0266737 A1 * 10/2009 Cole ..... 206/499

OTHER PUBLICATIONS

Nalgene Outdoor, "Cleaning your Nalgene Bottles", May 15, 2009, <http://www.nalgene-outdoor.com/technical/cleaning/index.html>.
SIGG, "SIGG Silver Traveler 0.6L (20 oz)", May 15, 2009, <http://www.mysigg.com/index.asp?PageAction=VIEWPROD&ProdID=248>.

* cited by examiner

DUAL-CAPPED HYDRATION BOTTLE

FIELD

The present invention relates generally to hydration and fluid carrying devices, more specifically, a hydration bottle is described.

BACKGROUND

Conventional hydration devices such as water bottles are useful for various purposes in activities such as athletic, outdoor, recreational, or other uses. Typically, water bottles are designed for a user to carry water, electrolytic fluid replacement drinks, or any type of liquid or, in some cases, powders or other materials. In the field of bicycling, bottles are used to enable riders to drink or replenish fluid loss without stopping. Wire cages attached to bicycle frames are typically made of stainless steel, carbon fiber, plastic, or other materials are used to hold conventional bottles. However, whether in the field of bicycling or others, conventional hydration devices are problematic.

Constant or frequent use of hydration devices and bottles can lead to the repetitive need for cleaning. If conventional bottles are left with standing fluid or water within them, mold, mildew, or bacteria develops and can lead to difficult cleaning and, possibly, health-related problems for the user. Conventional bottles have a single top or cap that is often removable by unscrewing or exerting upward pressure to separate the top or cap from the body of the bottle. However, due to the design and shape of conventional bottles, comprehensive cleaning is difficult. Further, materials used to manufacture conventional bottles, if not cleaned frequently or in a timely fashion, lead to stains and other undesirable effects that can reduce the commercial value of a given bottle. Thus, what is needed is a hydration bottle without the limitations of conventional bottles.

BRIEF DESCRIPTION OF THE DRAWINGS

Various embodiments of the invention are disclosed in the following detailed description and the accompanying drawings:

FIG. 6 illustrates a top view of an exemplary hydration bottle;

DETAILED DESCRIPTION

Various embodiments or examples may be implemented in numerous ways, including as a system, a process, or an apparatus. A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1:
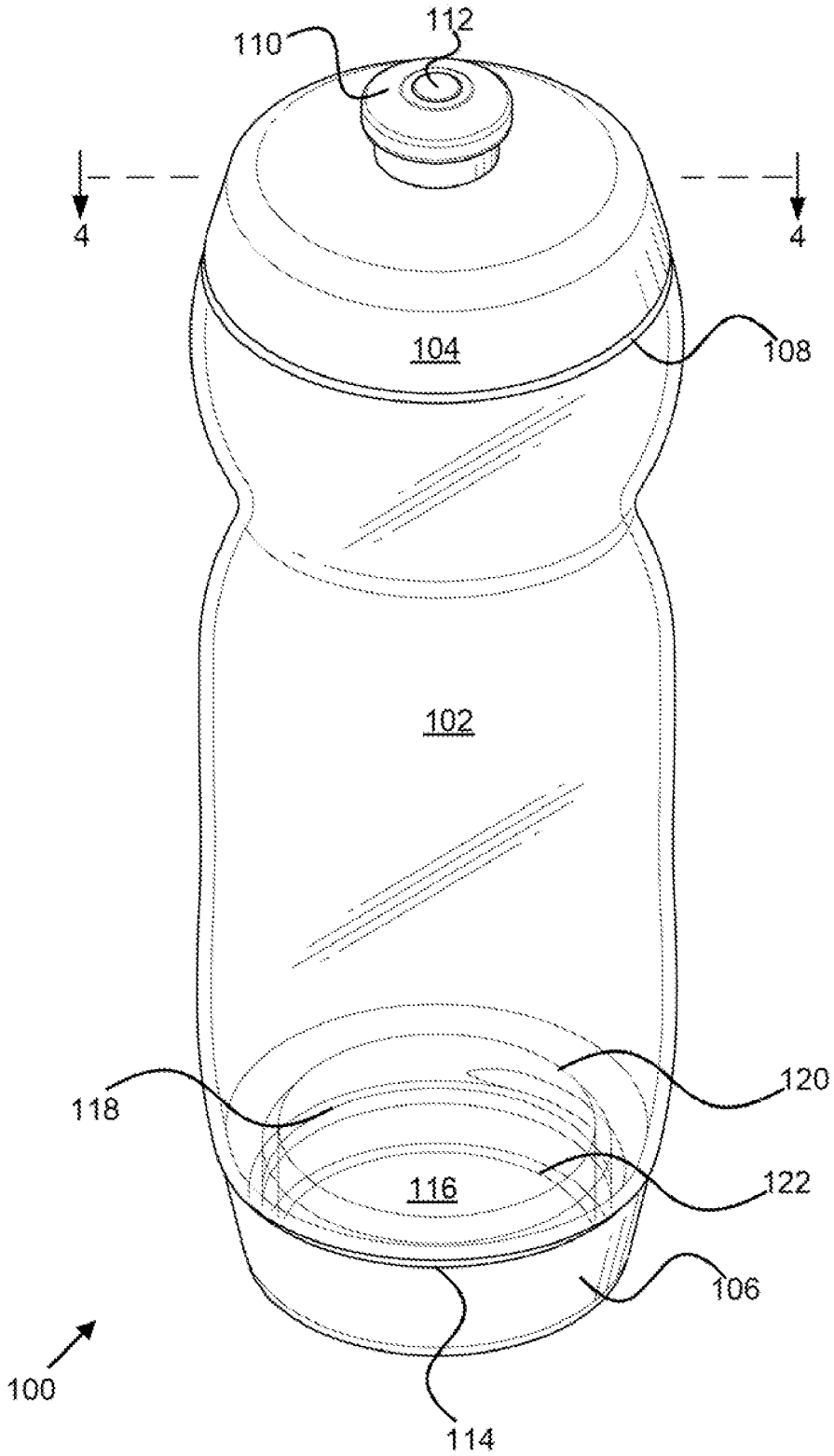
FIG. 1 illustrates a perspective view of an exemplary hydration bottle.

FIG. 1 illustrates a perspective view of an exemplary hydration bottle. Here, bottle 100 includes body 102, top cap or closure ("cap") 104, bottom cap or closure ("cap") 106, joint 108, nozzle 110, nozzle shaft 112, joint 114, bottom cap inner surface 116, continuous screw threads ("screw threads") 118, and bottom neck 120. Body 102, as shown, may be made, manufactured, molded (e.g., injection, cold, or the like), or otherwise formed using various materials, including, but not limited to plastic, low density plastic, high density plastic, polycarbonate, polycarbonate without Bisphenol-A (or other endocrine disrupting compounds), polyvinyl chloride ("PVC"), stainless steel, wood, aluminum, polyester, copolyester, or any other type of organic or synthetic materials, alloys, or composites. As shown, body 102 is transparent for purposes of describing various features.

In some examples, top cap 104 is joined to body 102 at joint 108. Top cap 104 may be joined to body 102 using various techniques including, but not limited to, continuous and non-continuous screw threads, adhesives, pressure-based coupling mechanisms (e.g., ridges), or others. For example, top cap 104 may be rotated to engage screw threads (not shown) disposed on body 102 with screw thread channels or canals (hereafter "channels") to create a seal that may be hermetic and watertight. In some examples, reference to screw thread channels may refer to a screw thread or set of screw threads that, when engaged with a corresponding screw thread or set of screw threads creates a seal between two elements providing, in some examples, an air-tight or water-tight (e.g., hermetic) seal. Likewise, bottom cap 106 may be coupled to body 102, forming joint 114. When bottom cap 106 is rotated onto bottom neck 120, screw threads 118 disposed on the external surface of bottom cap 106 are configured to engage channels formed on the inner surface of bottom cap 106, providing a seal that is watertight to prevent fluids from leaking out of body 102. When bottom cap 106 is fully engaged (i.e., screw threads 118 are fully engaged with channels formed on the inner surface of bottom cap 106), a lip (not shown, but described in more detail below) of bottom neck 120 contacts gasket 122 forming a seal to prevent fluid, liquid, or other materials from leaking from body 102 and bottle 100. In other examples, bottle 100 and the above-described elements may be varied in function, structure, shape, design, implementation, configuration, or other aspects without limitation to the descriptions provided.

Figure 2:
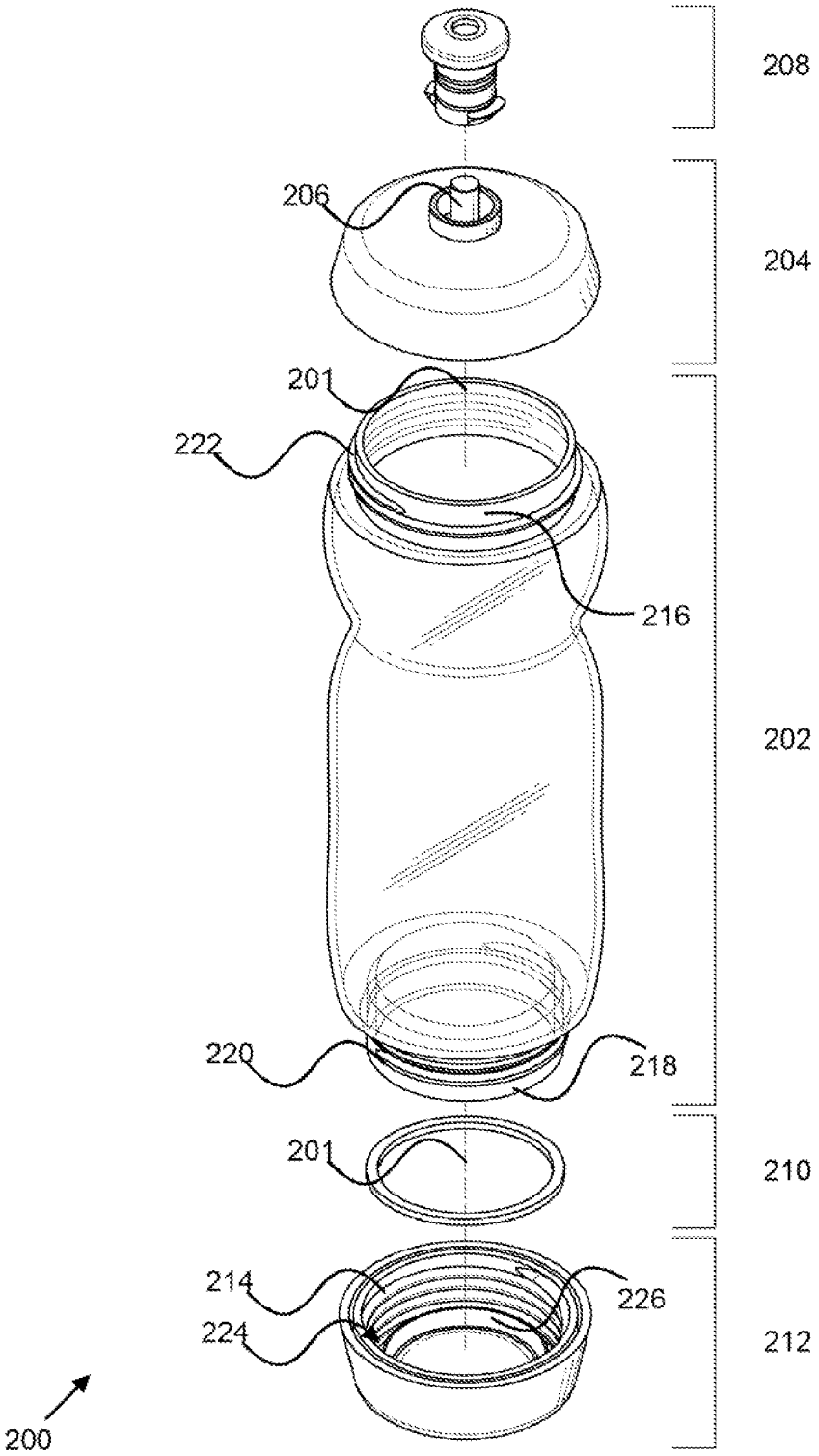
FIG. 2 illustrates an exploded view of an exemplary hydration bottle

FIG. 2 illustrates an exploded view of an exemplary hydration bottle. Here, bottle 200 is shown in an exploded configuration along axis 201, including body 202, top cap 204, nozzle shaft 206, nozzle assembly 208, gasket 210, bottom cap 212, bottom screw thread channel 214, top neck 216, bottom neck 218, and screw threads 220-222. In some examples, bottle 200 may be assembled by inserting nozzle assembly 208 over nozzle shaft 206 of top cap 204, which may be rotated onto helical screw threads 222 formed on the external surface of top neck 216. Screw threads 220-222, in some examples, may be formed by injection, cold, or other type of molding of materials used to form body 202, which may likewise be formed as a unitary element having top neck 216 and bottom neck disposed at the top and bottom of bottle 200, respectively. Likewise screw threads 220-222 may be patterned as continuous or non-continuous type screw threads having clockwise or counterclockwise helical patterns for rotating, top cap 204 or bottom cap 212 onto top neck 216 and bottom neck 218, respectively.

When assembled, bottom neck may be rotated or twisted onto bottom neck 218, resulting in the engagement of screw threads 220 with bottom screw thread channel 214 formed on the inner surface of bottom cap 212. When fully engaged, gasket 210 may be seated in canal 224, which is formed by canal wall 226 and the inner surface of bottom cap 212. The mating or contact of a lip (not shown) of bottom neck 218 with gasket 210 forms a seal to prevent liquids, fluids, or other materials from escaping from body 202 when bottom cap 212 is fully engaged with body 202 (i.e., rotated fully onto screw threads 220 of bottom neck 218). In other examples, bottle 200 and the above-described elements may be varied in function, structure, shape, design, implementation, configuration, or other aspects without limitation to the descriptions provided.

Figure 3:
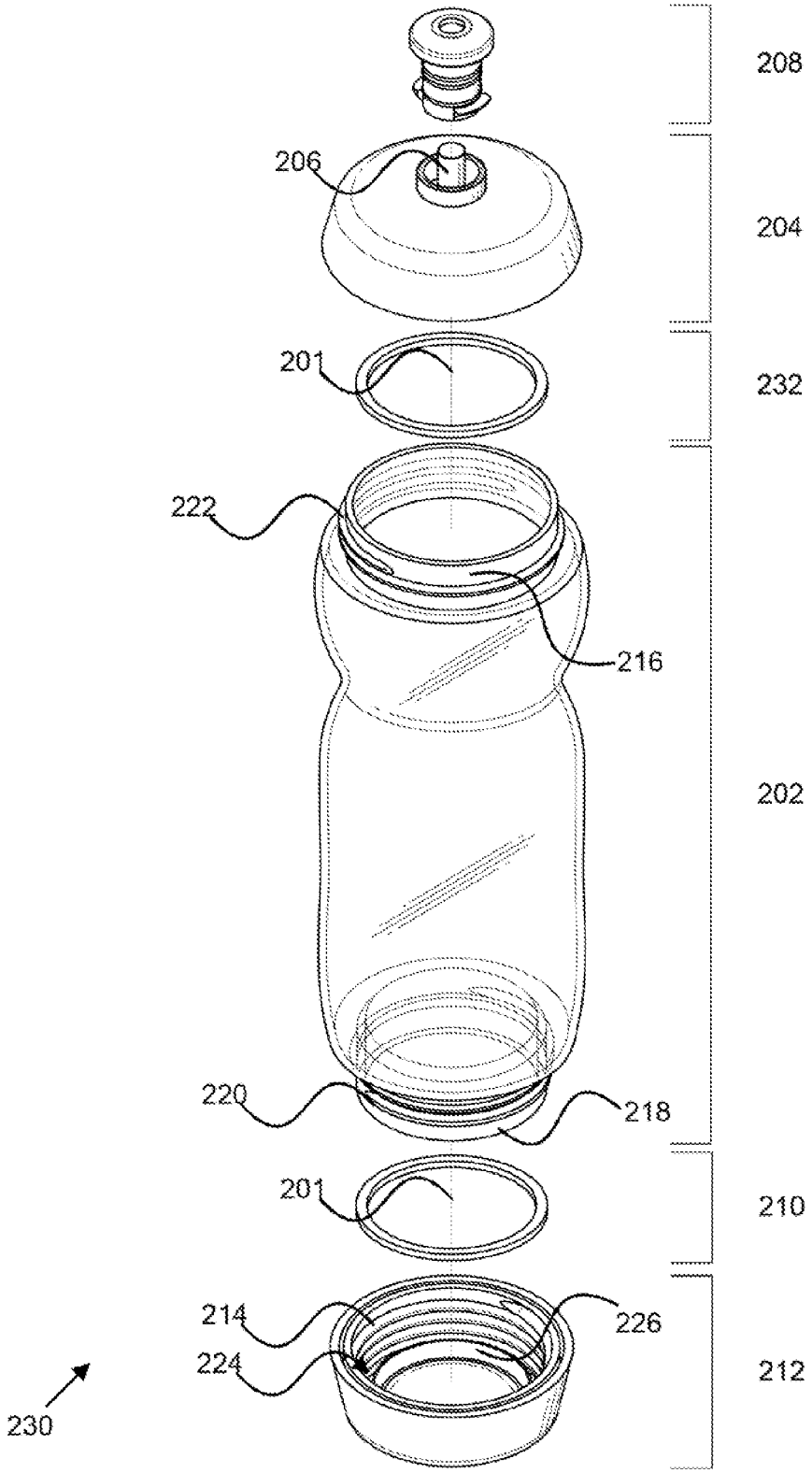
FIG. 3 illustrates an exploded view of an alternative exemplary hydration bottle.

FIG. 3 illustrates an exploded view of an alternative exemplary hydration bottle. Here, bottle 230 is shown in an exploded configuration along axis 201, including body 202, top cap 204, nozzle shaft 206, nozzle assembly 208, gasket 210, bottom cap 212, bottom screw thread channel 214, top neck 216, bottom neck 218, screw threads 220-222, and gasket 232. In some examples, axis 201, including body 202, top cap 204, nozzle shaft 206, nozzle assembly 208, gasket 210, bottom cap 212, bottom screw thread channel 214, top neck 216, bottom neck 218, and screw threads 220-222 may be implemented and described as set forth above in connection with FIG. 2. Alternatively, gaskets 210 and 232 may be used in top cap 204 and bottom cap 212, providing hermetic or watertight seals at both accesses (i.e., top cap 204, bottom cap 212) to body 202. Further, gaskets 210 and 232 may be eliminated entirely, in other examples, and instead materials and the structure of top cap 204 and bottom cap 212 may be modified to provide seals without gaskets. In other words, when top cap 204 and bottom cap 212 are rotated fully onto top neck 216 and bottom neck 218, seals may be formed without using gaskets 210 or 232. Still further, a single gasket may be used as opposed to a gasket at both ends (e.g., top cap 204, bottom cap 212). In other examples, further variations in one or more of elements 202-232 may be envisioned and are not limited by the examples shown and described above.

Figure 4:
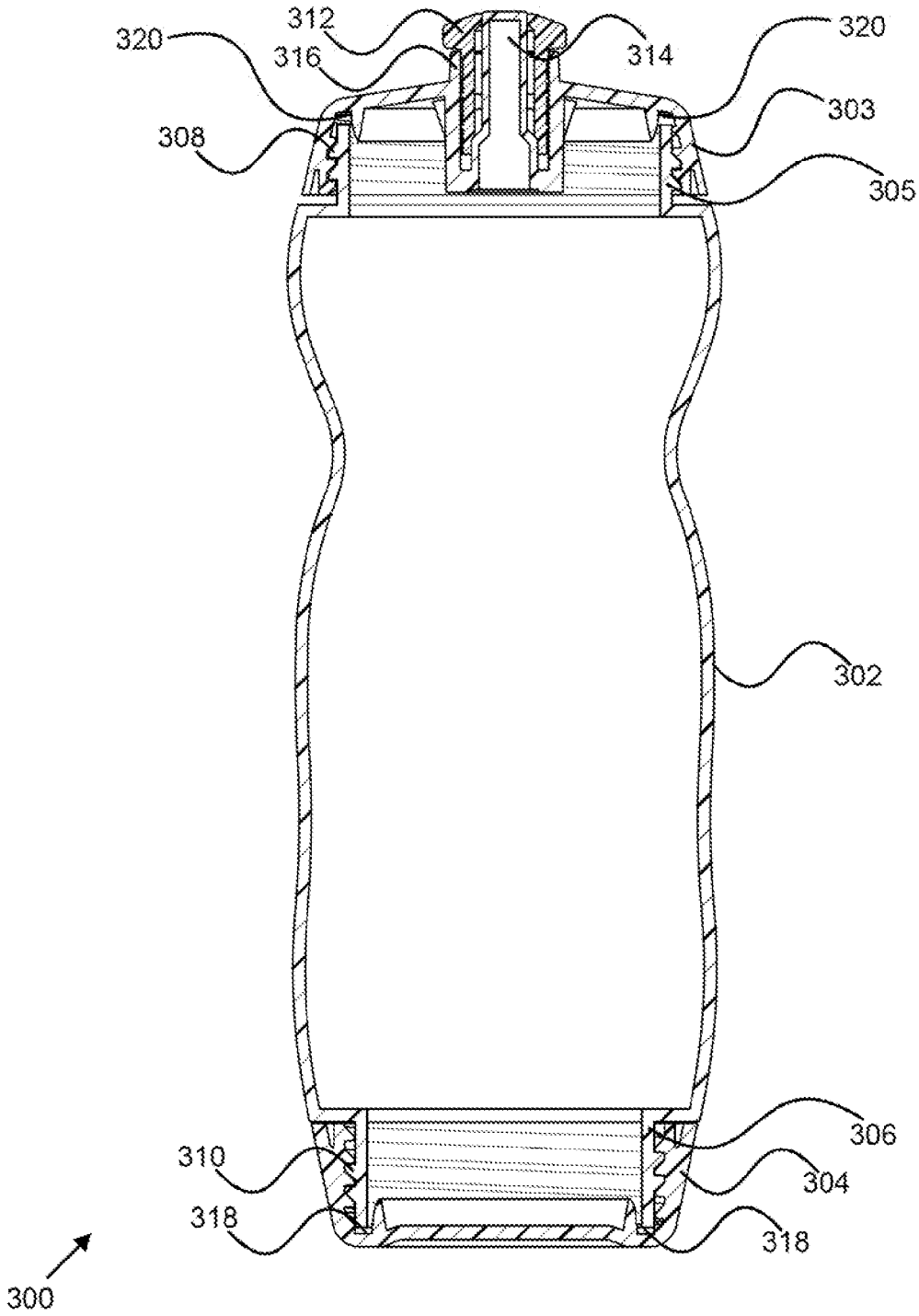
FIG. 4 illustrates a cross-sectional view of an exemplary hydration bottle.

FIG. 4 illustrates a cross-sectional view of an exemplary hydration bottle. Here, bottle 300 is shown in an assembled configuration including body 302, top cap 303, bottom cap 304, top neck 305, bottom neck 306, screw threads 308-310, nozzle 312, nozzle shaft 314, nozzle well 316, and gaskets 318-320. In some examples, when bottle 300 is assembled, top cap 303 is fully engaged (i.e., rotated) onto top neck 305 when screw threads 308 disposed on the external surface of top neck 305 are engaged with a screw thread channel (not shown) formed on the inner surface of top cap 303.

Here, nozzle 312 is shown in a retracted position within nozzle well 316. When nozzle 312 is retracted, a seal is formed between the inner surface of nozzle 312 and nozzle shaft 314, preventing fluid, liquid, or other materials from leaking, migrating, or otherwise egressing from bottle 300. However, when nozzle 312 is extracted (e.g., by pulling nozzle 312 in an outward axial (e.g., axis 201 (FIGS. 2-3)) direction, fluid, liquid, or other materials may flow around nozzle shaft 314 and exit from a center hole (not shown) in nozzle 312. Nozzle 312, nozzle shaft 314, and nozzle well 316 may also be referred to as a nozzle assembly. In other examples, nozzle 312, nozzle shaft 314, and nozzle well 316 may be varied in function, structure, operation, shape, design, configuration, implementation, or other aspects without limitation to the examples shown and described.

In some examples, bottom cap 304 may be formed using various materials, as described above. As part of the inner surface or wall of bottom cap 304, a screw thread channel (not shown) may be formed as a feature of bottom cap 304. In other words, when bottom cap 304 (or top cap 303) is formed, screw thread channels may be formed as an inner surface feature and configured to engage screw threads (e.g., screw threads 308-310). Here, when a screw thread channel of bottom cap 304 is fully engaged with screw thread 310, bottom neck 306 seats into a canal formed within the bottom, inner surface of bottom cap 306, mating or contacting gasket 318 in order to provide a hermetic or fluid-tight seal between bottom cap 304 and body 302. Similarly, top cap 303 may have a canal formed in which gasket 320 is seated in order to provide an additional seal when top neck 305 is fully rotated onto screw threads 308. By having a dual entry or access to body 302, bottle 300 may be used in a variety of applications for various materials and be accessible for thorough cleaning reducing development of mold, mildew, or other bacteria or fungi that may lead to health hazards, infections, or contamination. In other examples, bottle 300 and the above-described elements may be varied in function, structure, shape, design, implementation, configuration, or other aspects without limitation to the descriptions provided.

Figure 5:
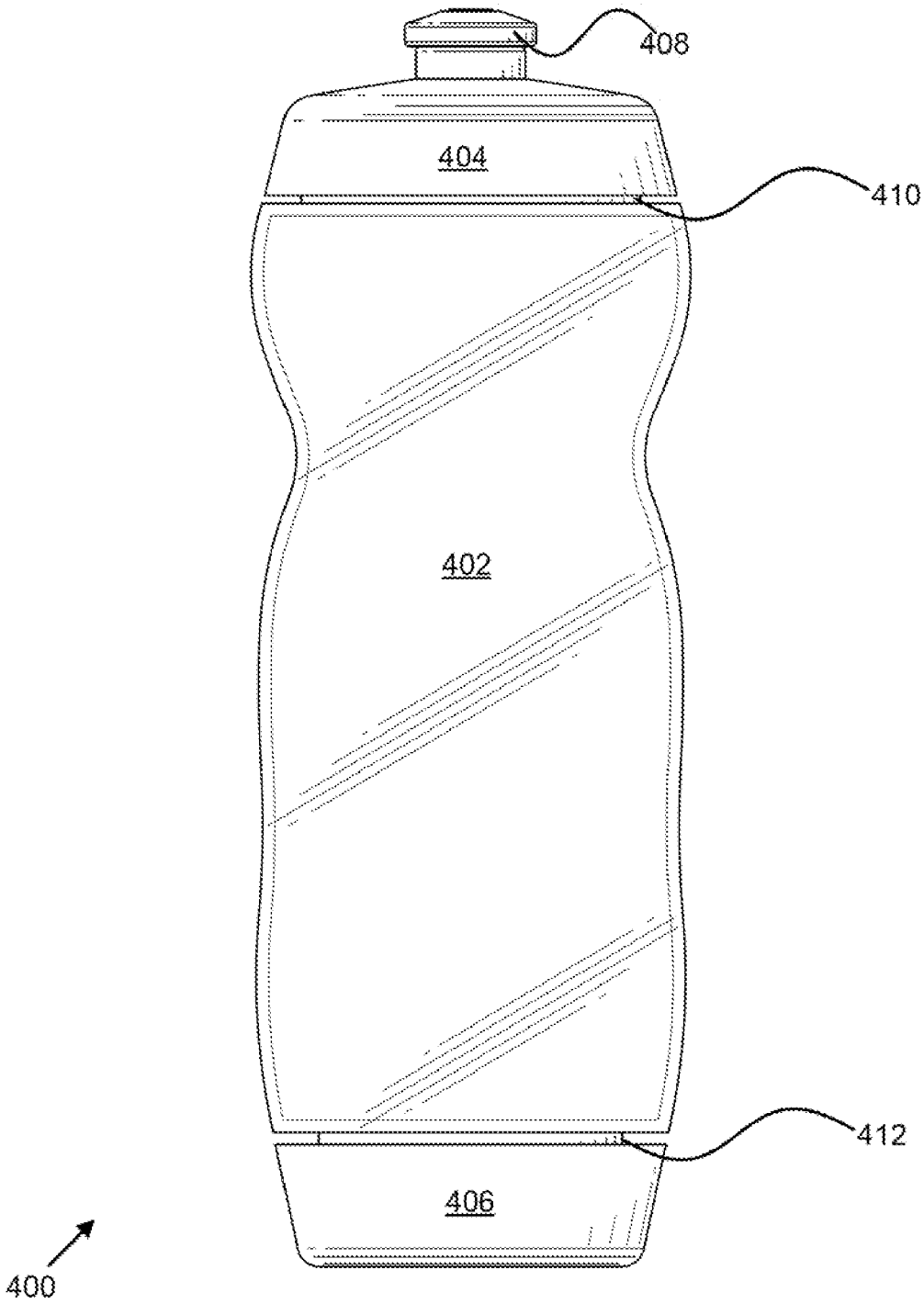
FIG. 5 illustrates an exterior side view of an exemplary hydration bottle.
Figure 5:
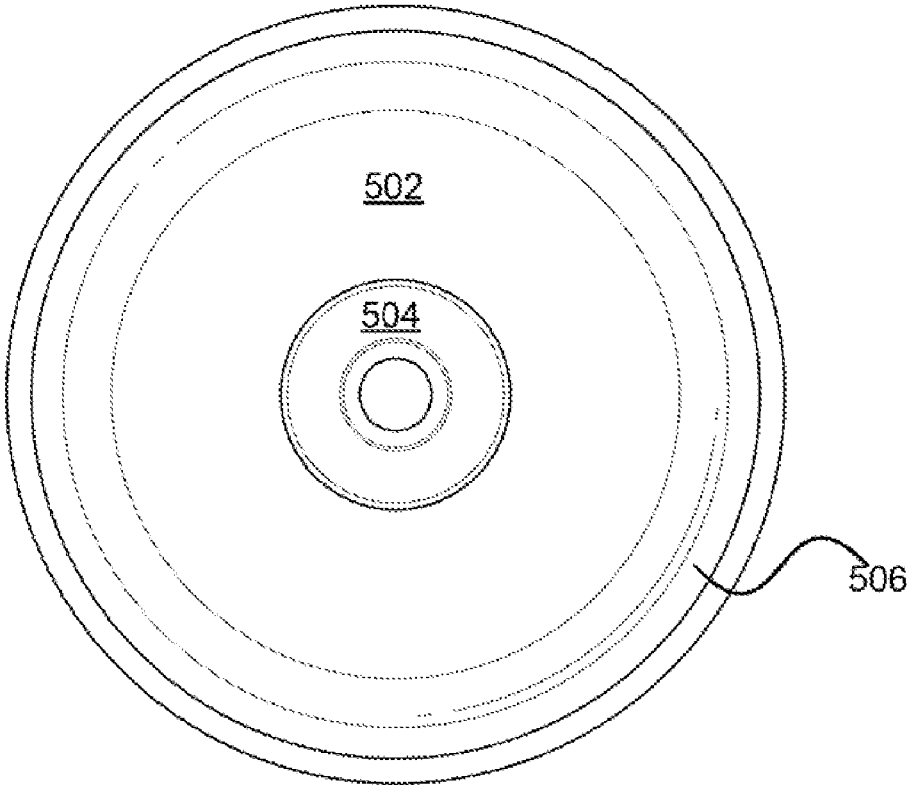

FIG. 5 illustrates an exterior side view of an exemplary hydration bottle. Here, bottle 400 includes top cap 404, bottom cap 406, and nozzle 408. Top neck 410 and bottom neck 412 are shown partially disposed between body 402 and top cap 404 and bottom cap 406, respectively. In some examples, when top cap 404 and bottom cap 406 are rotated onto and fully engaged with top neck 410 and bottom neck 412, respectively, a slight gap may be perceived between body 402 and top cap 404 and bottom cap 406. As an example, bottle 400 may be implemented similarly to bottles 100 (FIG. 1), 200 (FIGS. 2-3), or 300 (FIG. 4) or differently with regard to function, structure, shape, design, operation, materials, implementation, or other aspects, without limitation. While consistency in the shape of bottle 400 is shown with regard to bottles 100-300, limitation to this shape is not required and other implementations may be implemented using, for example, different nozzle assemblies, different top or bottom caps apart from top cap 404 or bottom cap 406, differently-shaped bodies apart from body 402, or other aspects or features. For example, body 402 may have straight side walls, eliminating the indentation as shown in the present example. As another example, anti-microbial materials may be used to injection mold using plastic one or more of the above-described elements, without limitation. As yet another example, materials such as stainless steel, wood, ceramic, or porcelain may be used. As shown here, body 402 may be molded using low density plastic materials in order to allow a user to "squeeze" bottle 400 in order to decrease the internal volume of body 402 and force liquid (e.g., water) through top cap 404 and nozzle 408. Still further, top cap 404 and bottom cap 406 may be configured to rotate onto and fully engage top neck 410 and bottom neck 412, respectively, in order to create a seal with body 402, eliminating the air gaps shown. In yet other examples, bottle 400 and the above-described elements may be varied in function, structure, shape, design, implementation, configuration, or other aspects without limitation to the descriptions provided.

FIG. 6 illustrates a top view of an exemplary hydration bottle. Here, top cap 502 is shown with nozzle 504 disposed centrally. Side wall 506 of top cap 502 is shown here as smooth, but in other examples, may have surface features or effects such as ridges, texture, or pre-formed structures that facilitate a user's grip when operating top cap 502. For example, if a bottle (e.g., bottle 100-400 (FIGS. 1-5)) is intended for use in competitive cycling, top cap 502 may be implemented with rough edges formed for side wall 506 in order to facilitate operation (e.g., opening or closing a bottle) when a user's hands are slick due to contact materials such as sweat, water, ice, oil, or the like. Although not shown, surface effects on side wall 506 may be formed as part of top cap 502 or applied after top cap 502 is formed. Still further, various types of surface effects or features such as ridges, non-skid grip materials, or the like may be applied, without limitation. In yet other examples, top cap 502 and the above-described elements may be varied in function, structure, shape, design, implementation, configuration, or other aspects without limitation to the descriptions provided.

Figure 7:
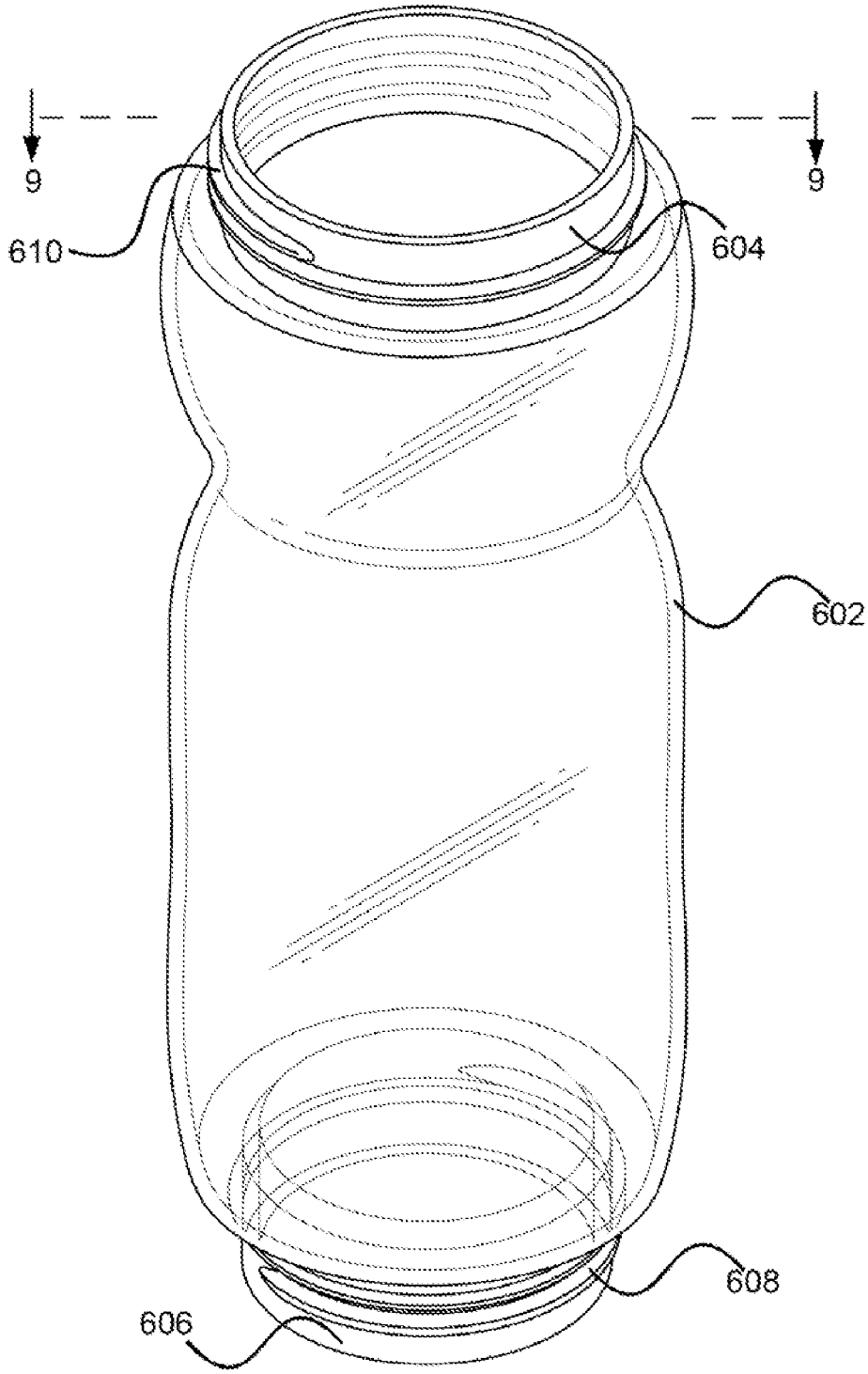
FIG. 7 illustrates a perspective view of an exemplary hydration bottle body.

FIG. 7 illustrates a perspective view of an exemplary hydration bottle body. Here, body 602 includes top neck 604, bottom neck 606, and screw threads 608-610. In some examples, body 602 may be formed (e.g., using injection, pressure, or cold molding or other techniques), as a monolithic component, various features, including top neck 604, bottom neck 606, and screw threads 608-610. Alternatively, features (e.g., top neck 604, bottom neck 606, screw threads 608-610) may be formed as separate components and coupled to body 602 using adhesives, heat, or other applications and techniques. In yet other examples, body 602 and the above-described elements may be varied in function, structure, shape, design, implementation, configuration, or other aspects without limitation to the descriptions provided.

Figure 8:
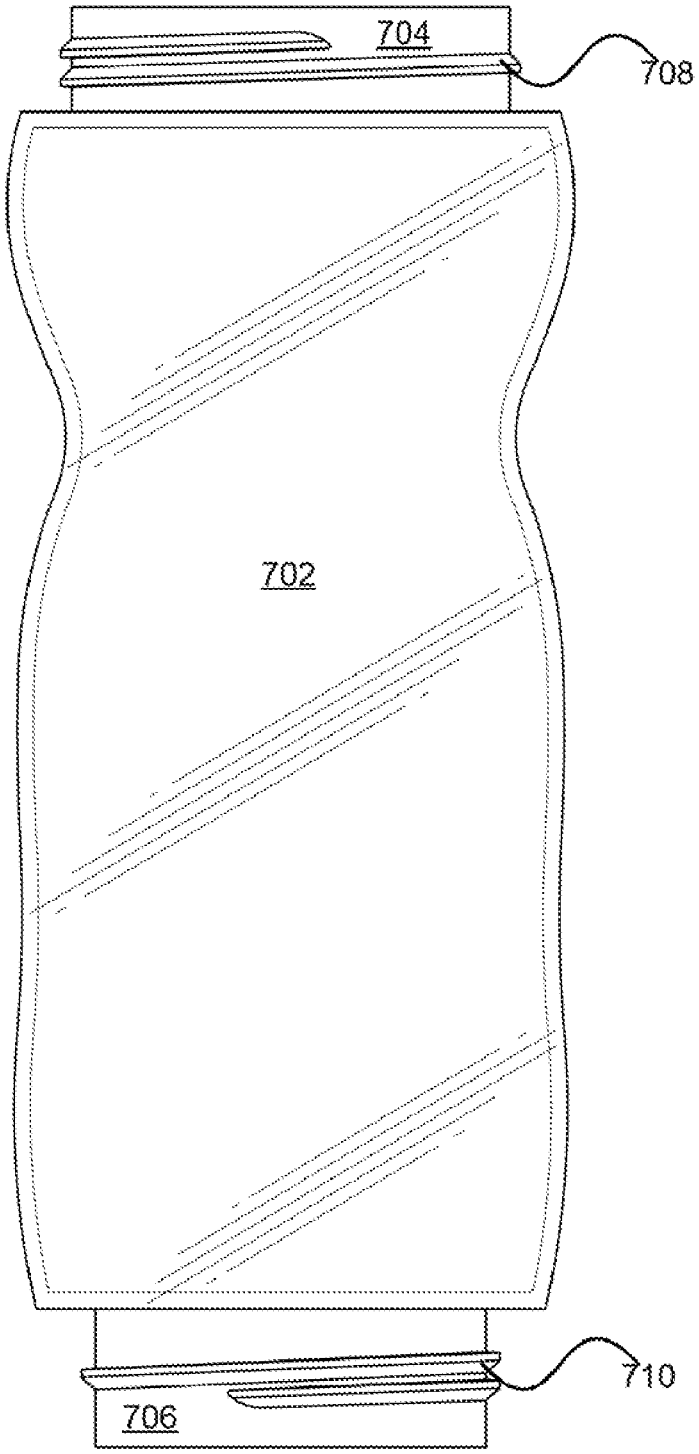
FIG. 8 illustrates a side view of an exemplary hydration bottle body.

FIG. 8 illustrates a side view of an exemplary hydration bottle body. Here, body 702 is shown including top neck 704, bottom neck 706, and screw threads 708-710. As shown from an external side view, body 702 may be formed as a single element, having top neck 704 and bottom neck 706 as features disposed at either end of the elongated ends of body 702. Further, screw threads 708-710 may be molded as part of top neck 704 and bottom neck 706, respectively. By injecting additional materials into a mold (e.g., injection, pressure, cold, or others), for example, screw threads 708-710 may be formed. The use of materials having a material memory may be used to enable a user to squeeze or apply external pressure to body 702 in order to press stored liquids, fluids, or other materials through a nozzle (e.g., nozzle 408 (FIG. 5)) and, as air or other gases flow into body 702, a shape is reassumed from a previously deformed state. In other examples, high density plastic materials or stiffer or high density materials such as metals, wood, or other types of plastic (e.g., polycarbonate, copolyester, or others) may be used. Body 702, may be formed also by assembling separate elements in order to create top neck 704, bottom neck 706, and screw threads 708-710. Further, although screw threads 708-710 are shown as continuous, helical screw threads, different types of screw threads or coupling mechanisms (e.g., non-continuous, ridges, or others) may be used without limitation. In still other examples, body 702 and the above-described elements may be varied in function, structure, shape, design, implementation, configuration, or other aspects without limitation to the descriptions provided.

Figure 9:
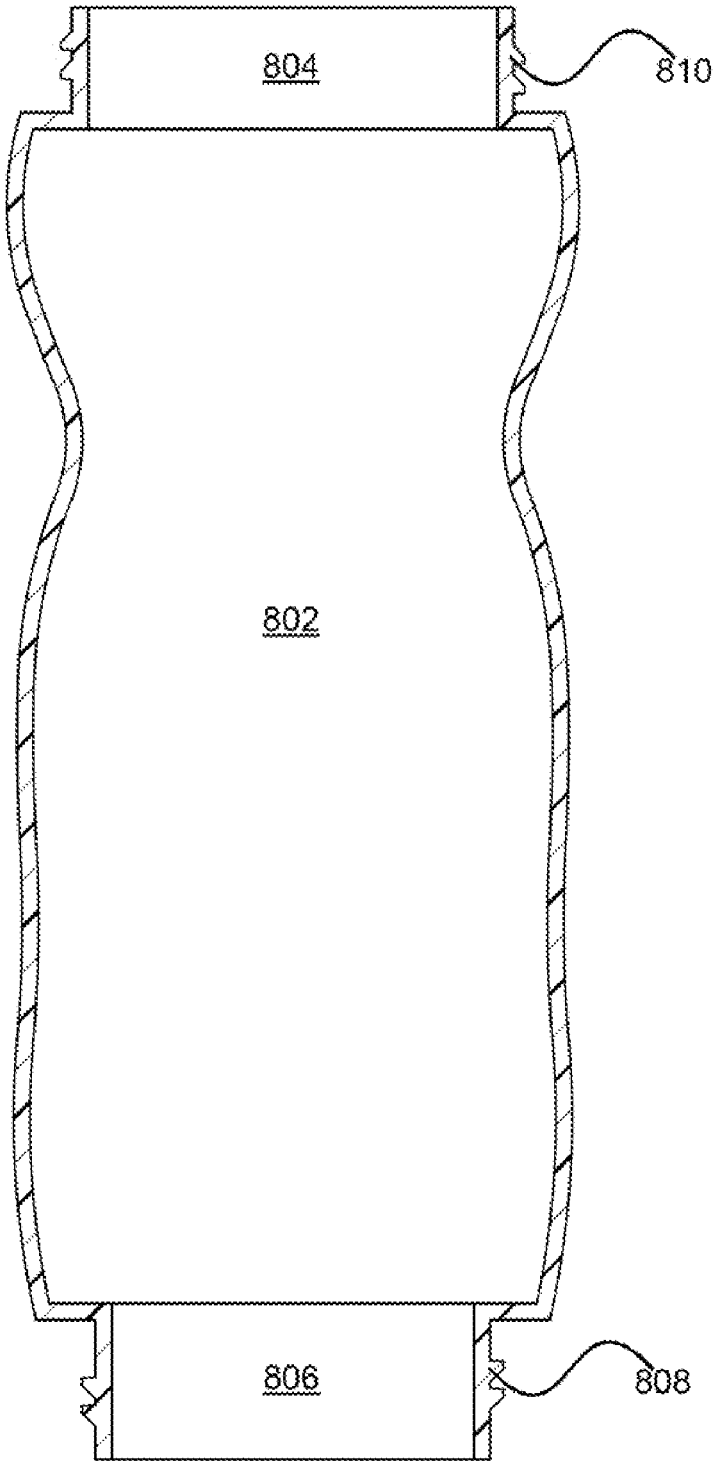
FIG. 9 illustrates a cross-sectional view of an exemplary hydration bottle body.

FIG. 9 illustrates a cross-sectional view of an exemplary hydration bottle body. Here, body 802 includes top neck 804, bottom neck 806, and screw threads 808-810. As described above in connection with FIG. 8, one, some, or all of body 802, top neck 804, bottom neck 806, and screw threads 808-810 may be implemented similarly or substantially similar to the elements shown and described in FIG. 8, including top neck 704, bottom neck 706, and screw threads 708-710. In other examples, body 802 and the above-described elements may be varied in function, structure, shape, design, implementation, configuration, or other aspects without limitation to the descriptions provided.

Figure 10:
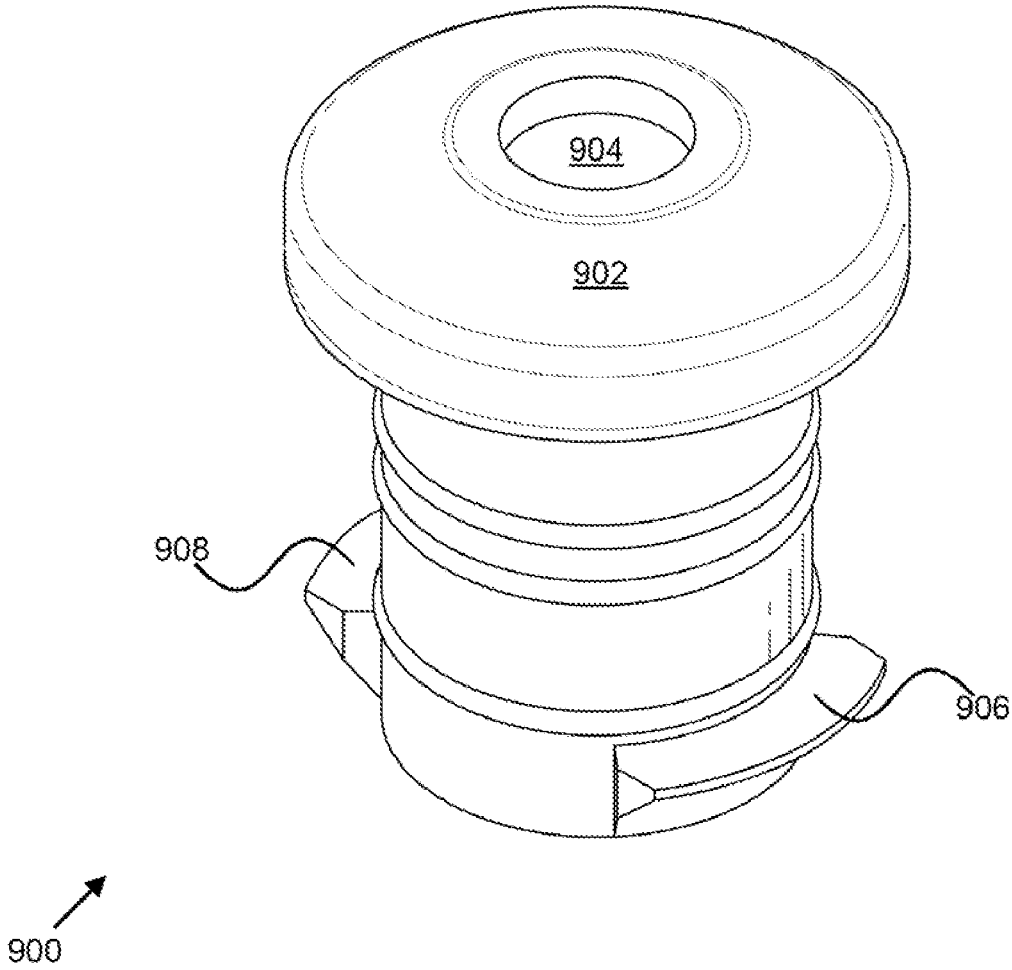
FIG. 10 illustrates a perspective view of an exemplary hydration bottle nozzle assembly.

FIG. 10 illustrates a perspective view of an exemplary hydration bottle nozzle assembly. Here, nozzle assembly 900 includes nozzle 902, center hole 904, and nozzle guides 906-908. In some examples, nozzle assembly 900 may be configured for insertion into a nozzle well (e.g., nozzle well 316 (FIG. 4)) disposed in a top cap (e.g., top cap 204 (FIGS. 2-3)) using nozzle guides 906-908 to guide and lock nozzle assembly 900 into place within a top cap. Further, nozzle guides 906-908 may be configured to allow extraction and retraction of nozzle assembly 902 to and from top cap 204, but prevent a user from complete removal or detachment. In other examples, guides 906-908 may be used to guide insertion of nozzle 902 into, for example, nozzle well 316. In other examples, guides 906-908 may be implemented differently and are not limited to the examples shown and described. Further, nozzle assembly 900 and the above-described elements may be varied in function, structure, shape, design, implementation, configuration, or other aspects without limitation to the descriptions provided.

Figure 11:
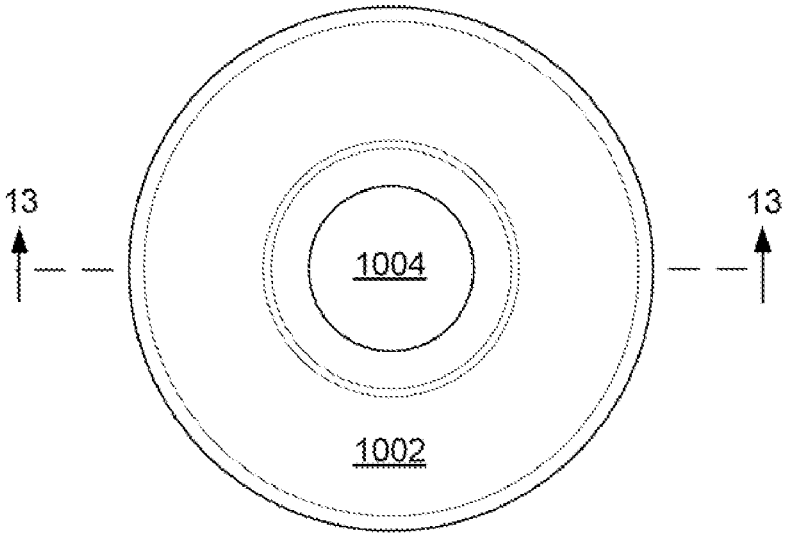
FIG. 11 illustrates a top view of an exemplary hydration bottle nozzle assembly.

FIG. 11 illustrates a top view of an exemplary hydration bottle nozzle assembly. Here, nozzle 1002 is shown with center hole 1004. In some examples, a top view of nozzle 1002 illustrates the central placement of center hole 1004, from which fluid, liquid, or other materials may be dispensed from a bottle (e.g., bottle 100-400 (FIGS. 1-5)). Further, nozzle shaft 206 (FIGS. 2-3) may be guided and inserted into center hole 1004 when nozzle 1002 is retracted into top cap 204 (FIGS. 2-3). In other examples, nozzle 1002 may be varied in function, structure, shape, design, implementation, configuration, or other aspects without limitation to the descriptions provided.

Figure 12:
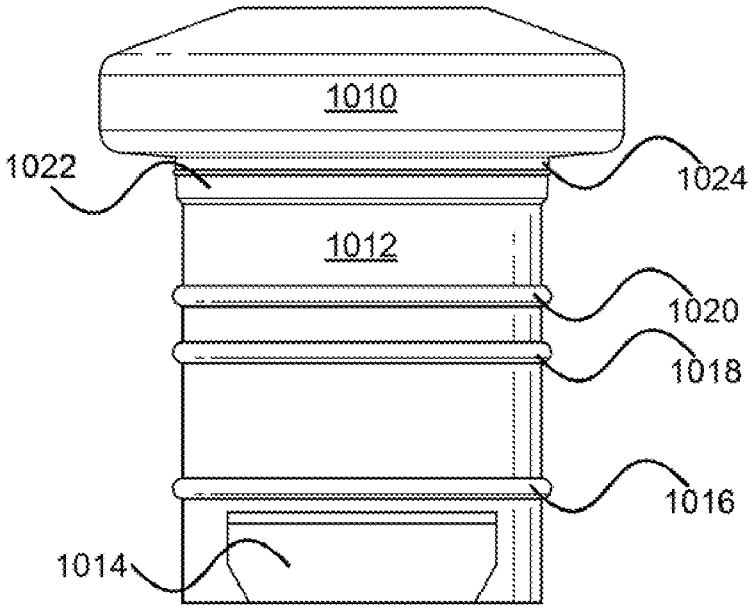
FIG. 12 illustrates a side view of an exemplary hydration bottle nozzle assembly.

FIG. 12 illustrates a side view of an exemplary hydration bottle nozzle assembly. Here, nozzle 1010 is shown, including nozzle body 1012, nozzle guide 1014, and seal ridges 1016-1024. In some examples, nozzle 1010 may be formed as a single, monolithic component using various techniques (e.g., pouring, injection molding, pressure molding, cold molding, or others), including forming nozzle 1010 and nozzle body 1012 as a single element.

As shown, seal ridges 1016-1024 may be formed as external surface features of nozzle body 1012 for use when pressing nozzle 1010 into a nozzle well (e.g., nozzle well 316 (FIG. 4)). As described above, nozzle guide 1014 (which may be implemented with or without a counterpart disposed on the opposite side of nozzle body 1012) may be configured to lock and guide nozzle 1010 into a nozzle well, preventing full removal or extraction rendering a nozzle-operated hydration bottle from usability. In other examples, nozzle 1010 may be varied in function, structure, shape, design, implementation, configuration, or other aspects without limitation to the descriptions provided.

Figure 13:
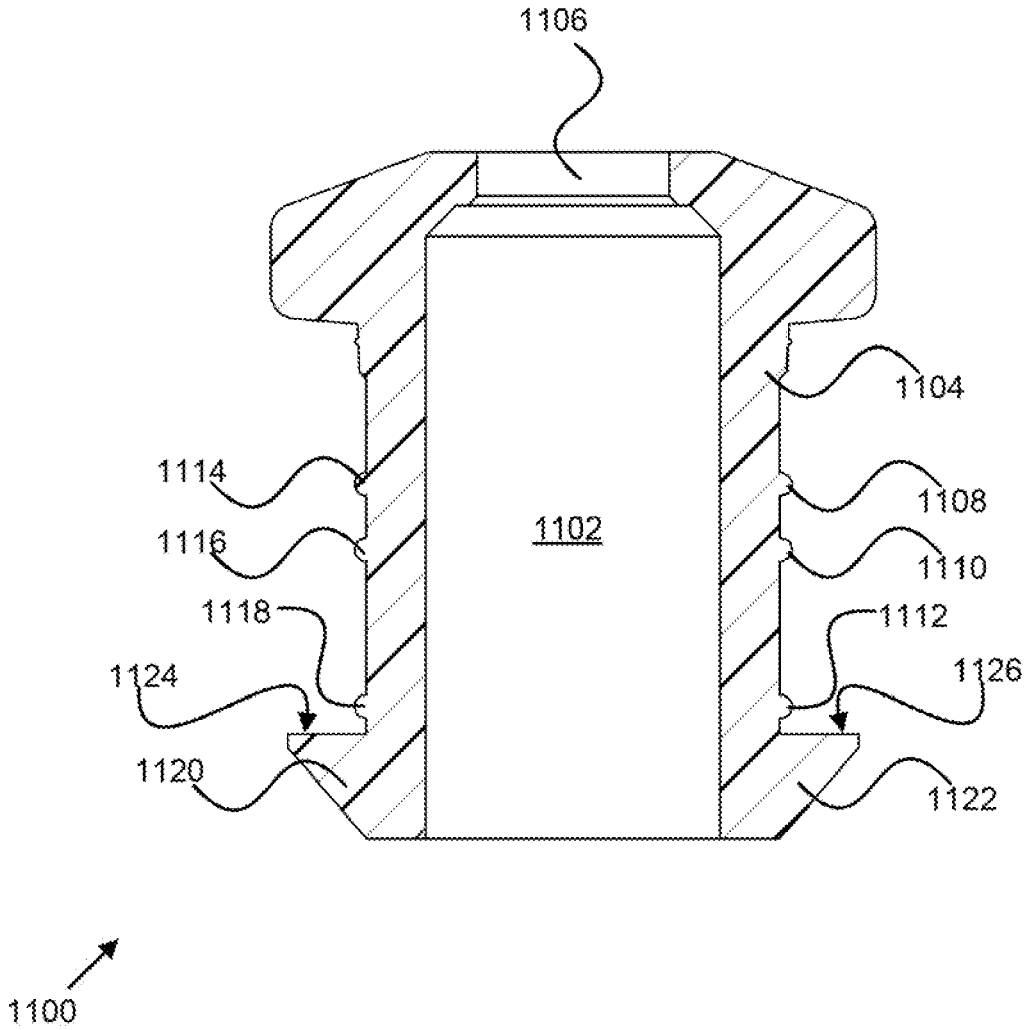
FIG. 13 illustrates a cross-sectional view of an exemplary hydration bottle nozzle assembly.

FIG. 13 illustrates a cross-sectional view of an exemplary hydration bottle nozzle assembly. Here, nozzle assembly 1100 illustrates nozzle body 1104, nozzle shaft 1102, center hole 1106, and seal ridges 1108-1118. In some examples, nozzle body 1104 may be inserted into a nozzle well (e.g., nozzle well 316 (FIG. 4)) and locked into place using nozzle guides 1120-1122. When upper surfaces 1124-1126 of nozzle guides 1120-1122 contact the inner surface of top cap 303 (FIG. 4), nozzle body 1104 is prevented from being completely extracted or withdrawn from top cap. Further, when initial assembly of a bottle (e.g., bottle 100-400 (FIGS. 1-5)) is performed, nozzle guides 1120-1122 are used to secure nozzle assembly 1100 into place within top cap 204. In other examples, nozzle assembly 1100 may be varied in function, structure, shape, design, implementation, configuration, or other aspects without limitation to the descriptions provided.

Figure 14:
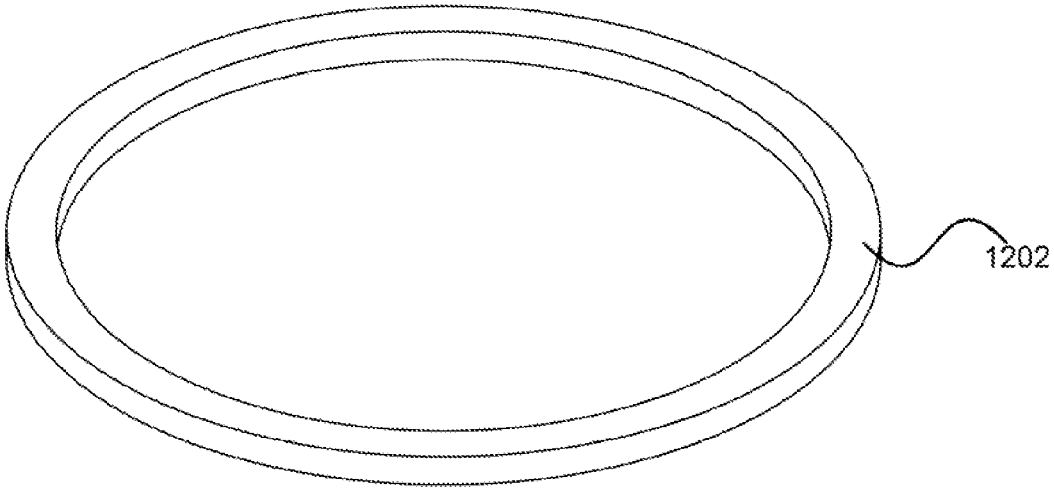
FIG. 14 illustrates a perspective view of an exemplary hydration bottle gasket.

FIG. 14 illustrates a perspective view of an exemplary hydration bottle gasket. Here, gasket 1202 may be inserted within a canal (e.g., canal 224 (FIGS. 2-3)) and used to seal a bottom cap with a body of a bottle in order to prevent leakage. In some examples, gaskets may be made of various types of materials, including plastic, silicone, metals, metal alloys, wood, cloth, or any other type of organic or inorganic material, without limitation to any specific implementation. Further, gasket 1202 may be coated with a substance or material to enhance the hermetic nature of any seal formed by contact with, for example, a lip of a bottom neck of a bottle, such as those shown and described above. Alternatively and as discussed above, hydration bottles such as those described herein may be implemented without using gasket 1202 entirely. In other examples, gasket 1202 may be varied in function, structure, shape, design, implementation, configuration, or other aspects without limitation to the descriptions provided.

Figure 15:
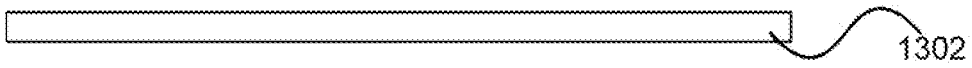
FIG. 15 illustrates a side view of an exemplary hydration bottle gasket.

FIG. 15 illustrates a side view of an exemplary hydration bottle gasket. Here, gasket 1302, which may be implemented similarly or substantially similar to gasket 1202 (FIG. 14), is shown from a side view. In some examples, gasket 1302 may be formed using anti-microbial materials that are designed to resist mold, mildew, bacterial, or fungal development. When formed, gasket 1302 may be formed using different techniques than those used to form other elements of a hydration bottle such as those described herein. For example, gasket 1302 may be formed using nanotechnology or carbon nanotube materials for producing low-porous materials configured to resist liquid permeation or other detrimental effects in hydration devices. Further, gasket 1302 may be formed from puncture or tear-resistant materials configured to resist applied torque as gasket 1302 contacts a lip of a bottom neck of a hydration bottle. In other examples, gasket 1302 may be varied in function, structure, shape, design, implementation, configuration, or other aspects without limitation to the descriptions provided.

Figure 16:
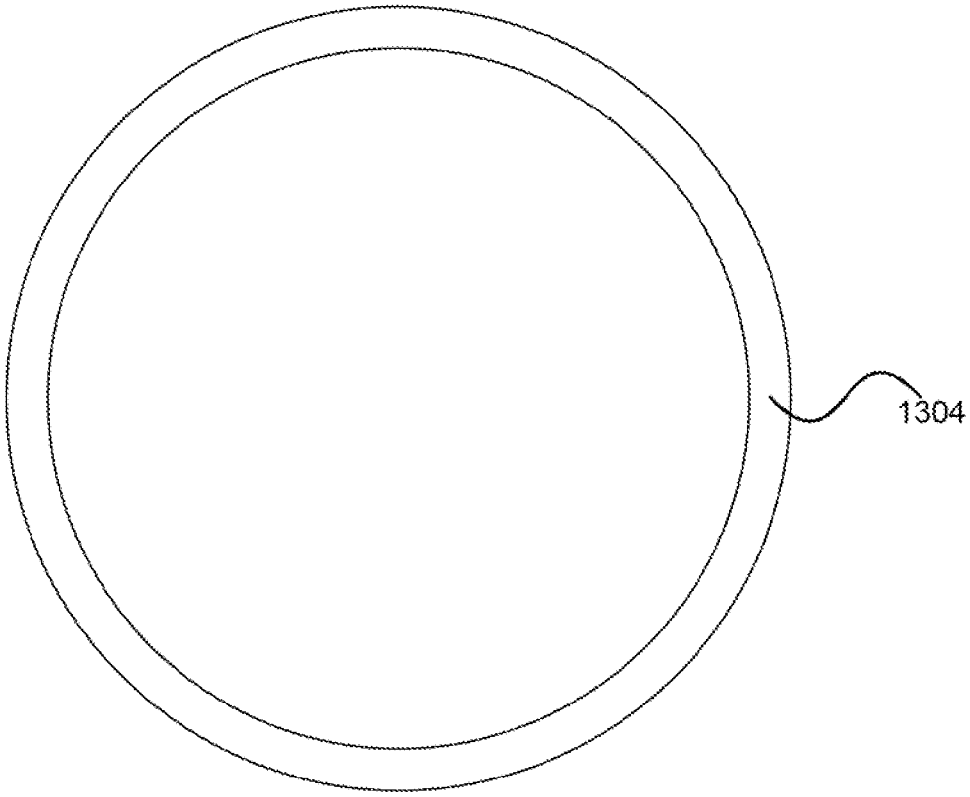
FIG. 16 illustrates a top or bottom view of an exemplary hydration bottle gasket.

FIG. 16 illustrates a top or bottom view of an exemplary hydration bottle gasket. Here, gasket 1304, which may be implemented similarly or substantially similar to gasket 1202 (FIG. 14) or gasket 1302 (FIG. 15) is shown from a top or bottom view. In other examples, gasket 1302 may be varied in function, structure, shape, design, implementation, configuration, or other aspects without limitation to the descriptions provided.

Figure 17:
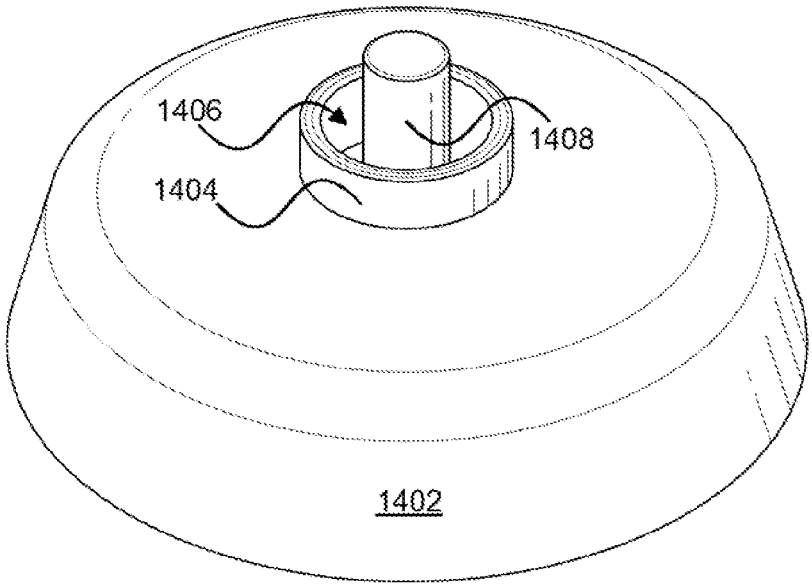
FIG. 17 illustrates a perspective view of an exemplary hydration bottle top cap or closure.

FIG. 17 illustrates a perspective view of an exemplary hydration bottle top cap or closure. Here, top cap 1402 includes nozzle well wall 1404, nozzle well 1406, and nozzle shaft 1406. In some examples, top cap 1402, nozzle well wall 1404, nozzle well 1406, and nozzle shaft 1408 may be formed as a single element by, for example, using molding, shaping, or fabrication techniques. When formed, nozzle well wall 1404, nozzle well 1406, and nozzle shaft 1408 may be implemented as fabricated features (i.e., features that are formed as an integral part of another element (e.g., top cap 1402)) of top cap 1402. In other examples, nozzle well wall 1404 and nozzle shaft 1408 may be formed as separate elements apart from top cap 1402 and, using adhesive, heat treatments, or other techniques, coupled together. In still other examples, top cap 1402 and the above-described elements may be varied in function, structure, shape, design, implementation, configuration, or other aspects without limitation to the descriptions provided.

Figure 18:
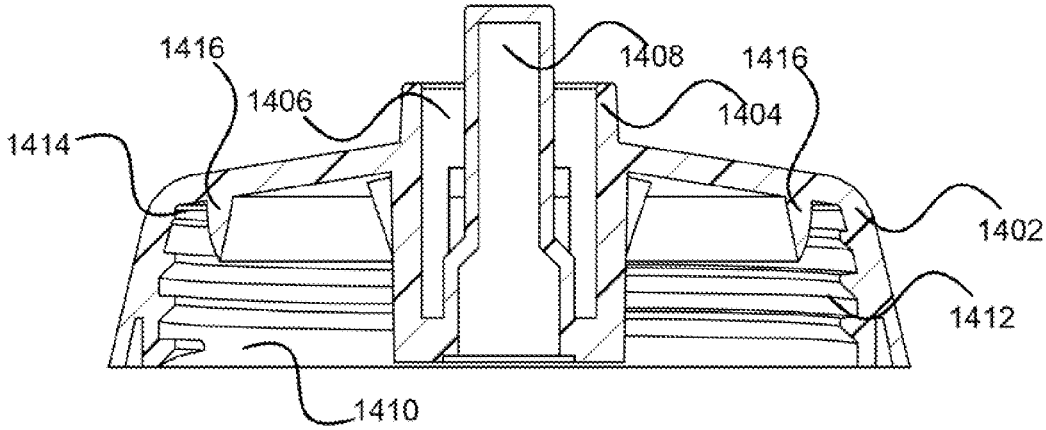
FIG. 18 illustrates a cross-sectional view of an exemplary hydration bottle top cap or closure.

FIG. 18 illustrates a cross-sectional view of an exemplary hydration bottle top cap or closure. Here, top cap 1402 includes nozzle well wall 1404, nozzle well 1406, nozzle shaft 1408, inner surface 1410, screw thread channel 1412, gasket 1414, and canal wall 1416. In some examples, screw thread channel 1412 may be formed as part of top cap 1402 as a feature on inner surface 1410. Further, canal wall 1416 may also be formed, creating a canal between canal wall 1416 and the outer structure of top cap 1402 in which gasket 1414 may be seated. As shown, when top cap 1402 is fully rotated onto top neck 216 (FIGS. 2-3), a seal is formed as the upper lip (not shown) of top neck 216 contacts gasket 1414. In other examples, screw thread channel 1412 may be formed differently using various techniques without limitation. In still other examples, top cap 1402 and the above-described elements may be varied in function, structure, shape, design, implementation, configuration, or other aspects without limitation to the descriptions provided.

Figure 19:
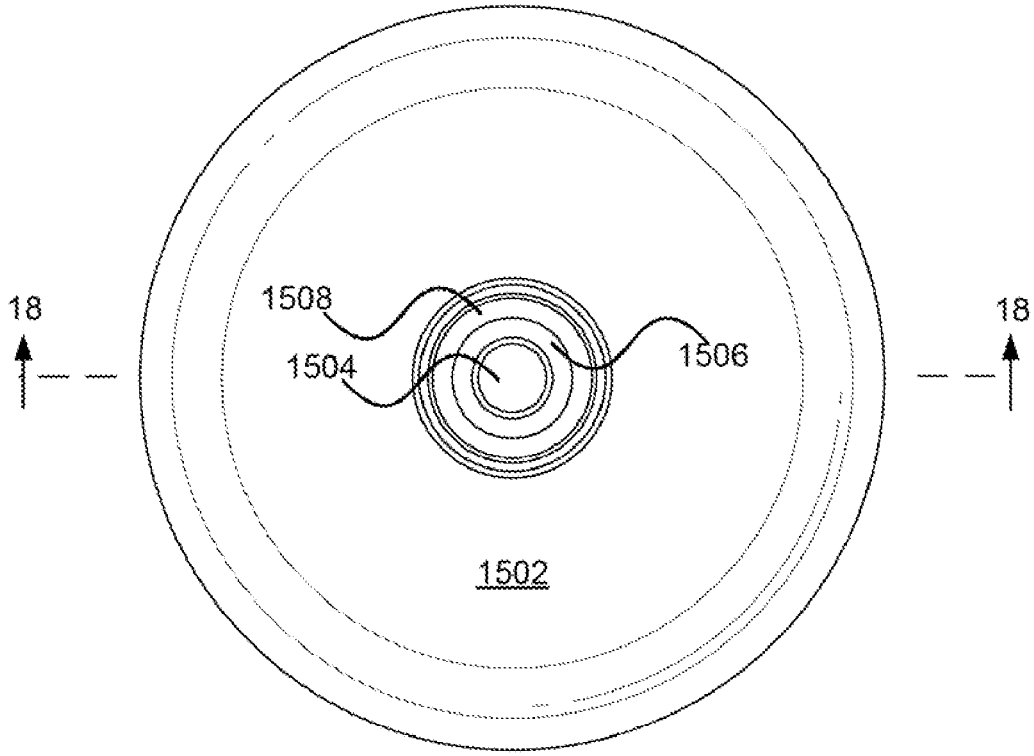
FIG. 19 illustrates a top view of an exemplary hydration bottle top cap or closure.

FIG. 19 illustrates a top view of an exemplary hydration bottle top cap or closure. Here, top cap 1502 includes nozzle shaft 1504, nozzle well 1506, and nozzle well wall 1508. In some examples, nozzle shaft 1504, nozzle well 1506, and nozzle well wall 1508 may be implemented similarly or substantially similar to nozzle well wall 1404, nozzle well 1406, and nozzle shaft 1406 (FIGS. 17-18). In other examples, top cap 1502 may be implemented differently and is not limited to the examples shown and described. Again, top cap 1502 and the above-described elements may be varied in function, structure, shape, design, implementation, configuration, or other aspects without limitation to the descriptions provided.

Figure 20:
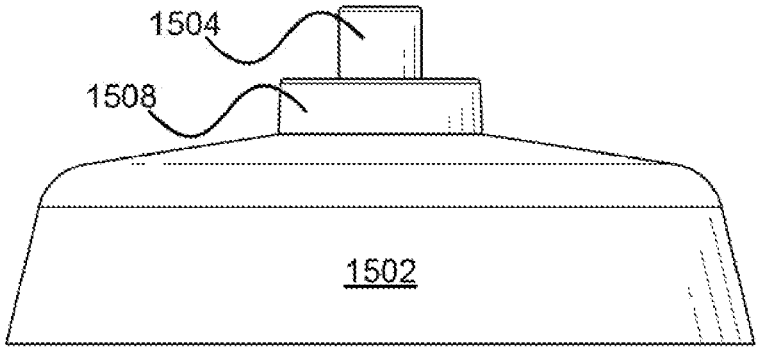
FIG. 20 illustrates a side view of an exemplary hydration bottle top cap or closure.

FIG. 20 illustrates a side view of an exemplary hydration bottle top cap or closure. Here, top cap 1502 is shown, including nozzle shaft 1504 and nozzle well wall 1508, which may be implemented differently without limitation to the examples shown and described. In other examples, top cap 1 502 and the above-described elements may be varied in function, structure, shape, design, implementation, configuration, or other aspects without limitation to the descriptions provided.

Figure 21:
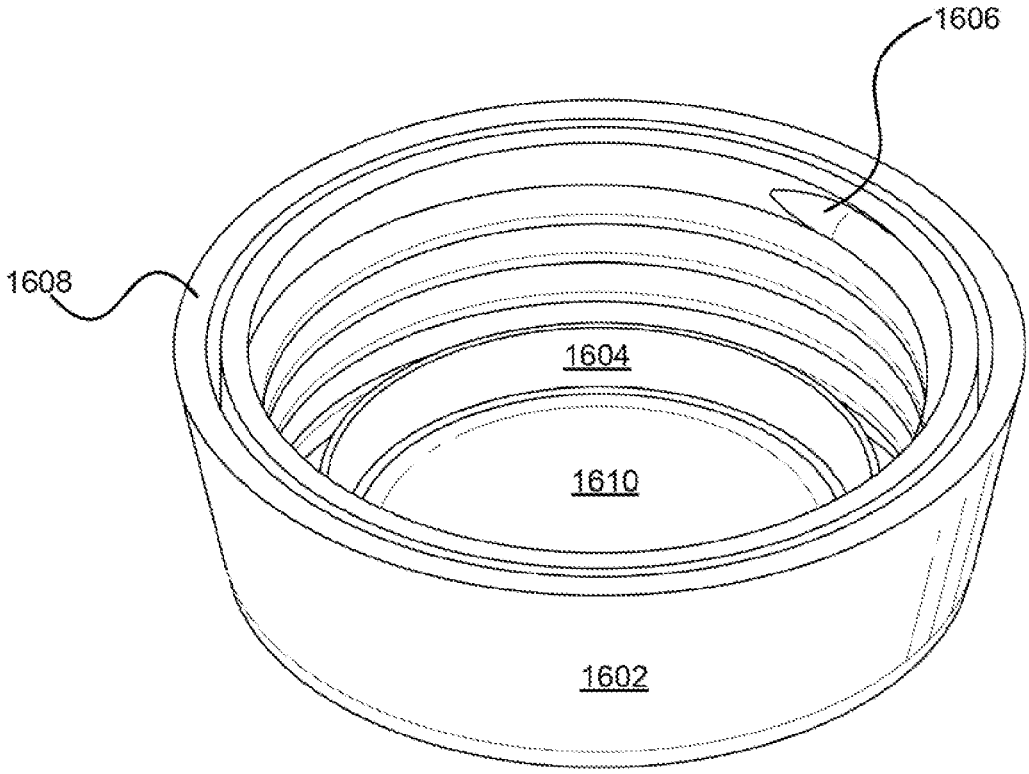
FIG. 21 illustrates a perspective view of an exemplary hydration bottle bottom cap or closure.

FIG. 21 illustrates a perspective view of an exemplary hydration bottle bottom cap or closure. Here, bottom cap 1602 is shown, including canal wall 1604, screw thread channel 1606, top lip 1608, and inner bottom surface 1610. In some examples, canal wall 1604, screw thread channel 1606, top lip 1608, and inner bottom surface 1610 may be formed as features of bottom cap 1602 during fabrication (e.g., pressure, injection, or cold molding, or others). When rotated in a clockwise or counterclockwise direction over, for example, bottom neck 218 (FIGS. 2-3), screw thread channel 1606 engages another screw thread (not shown) and creates a seal when bottom cap 1602 is fully engaged (i.e., rotated or screwed onto a bottom neck). Further, as screw thread channel 1606 engages another screw thread, a bottom lip associated with the bottom neck begins to seat in a canal (not shown; e.g., canal 224 (FIGS. 2-3)) until the bottom lip contacts a gasket seated within the canal. As torque is applied, screw thread channel 1606 engages a corresponding screw thread, seats the bottom lip associated with a bottom neck of a bottle, and, when the bottom lip contacts the seated gasket between the inner surface of bottom cap 1602 and canal wall 1604, a seal is formed. The seal, in some examples, is configured to be both airtight and water tight. When counter-rotational torque is applied, bottom cap 1602 may be removed from a bottle to permit dual-ended access for ease of cleaning or other purposes. As shown, bottom cap 1602 and the above-described features may be formed or fabricated using any technique, without limitation. Further, bottom cap 1602 and the above-described elements may be varied in function, structure, shape, design, implementation, configuration, or other aspects without limitation to the descriptions provided.

Figure 22:
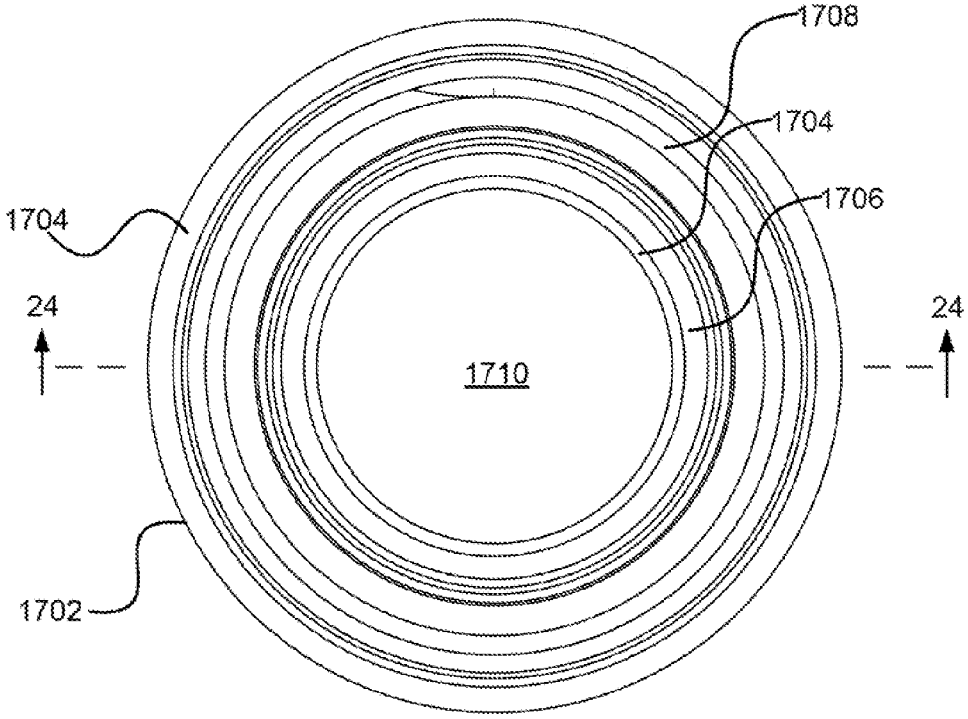
FIG. 22 illustrates a top view of an exemplary hydration bottle bottom cap or closure.

FIG. 22 illustrates a top view of an exemplary hydration bottle bottom cap or closure. Here, bottom cap 1702 includes top lip 1704, canal wall 1704, gasket 1706, screw thread channel 1708, and inner surface 1710. In some examples, top lip 1704, canal wall 1704, gasket 1706, screw thread channel 1708, and inner surface 1710 may be implemented similarly or substantially similar to those features shown and described above. As an example, bottom cap 1702 is shown with gasket 1706 seated in a canal, the latter of which may be formed between canal wall 1704 and inner surface 1710. As described above, when bottom cap is rotated onto and fully engages a screw thread disposed on an external surface of a bottom neck, for example, a seal is made when the bottom lip of the bottom neck contacts gasket 1706. In other words, a fully engaged screw thread with screw thread channel 1708 and the mating or contact of a bottom lip of a bottom neck with gasket 1706 forms an airtight or watertight seal. In other examples, bottom cap 1702 and the above-described elements may be varied in function, structure, shape, design, implementation, configuration, or other aspects without limitation to the descriptions provided.

Figure 23:
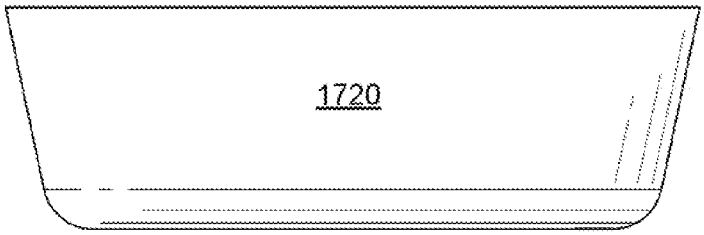
FIG. 23 illustrates a side view of an exemplary hydration bottle bottom cap or closure.

FIG. 23 illustrates a side view of an exemplary hydration bottle bottom cap or closure. Here, bottom cap 1720 is shown, which may be implemented similarly or substantially similarly to bottom cap 1702 (FIG. 22). Alternatively, bottom cap 1720 and the above-described elements may be varied in function, structure, shape, design, implementation, configuration, or other aspects without limitation to the descriptions provided.

Figure 24:
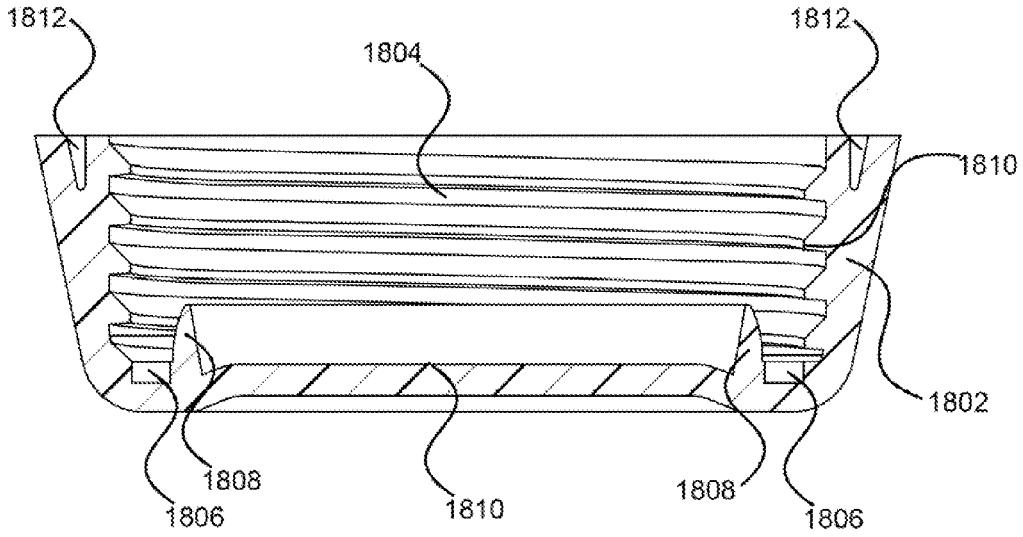
FIG. 24 illustrates a cross-sectional view of an exemplary hydration bottle bottom cap or closure.

FIG. 24 illustrates a cross-sectional view of an exemplary hydration bottle bottom cap or closure. Here, bottom cap 1802 is shown, including screw thread channel 1804, gasket 1806, canal wall 1808, inner surface 1810, and void 1812. In some examples, void 1812 may be used to provide an internal structure to support inner surface 1810, screw thread channel 1804, while reducing the amount of material used to form bottom cap 1802. The reduction of material used to form bottom cap 1802 provides further savings in both cost and weight, both of which may be considerable factors in determining the commercial value or appeal of a hydration bottle (e.g., bottle 200 (FIGS. 2-3)) over others.

In some examples, gasket 1806 is shown fully seated or placed within a canal formed by inner surface 1810 and canal wall 1808. Subsequently, when a bottom neck of a bottle is inserted into bottom cap and rotated in order to fully engage screw thread channel 1804, the bottom lip of the bottom neck will contact and seat with gasket 1806. Further, canal wall 1808 guides and provides additional sealing protection when a bottom neck is seated. In other examples, bottom cap 1802 and the above-described elements may be varied in function, structure, shape, design, implementation, configuration, or other aspects without limitation to the descriptions provided.

Figure 25:
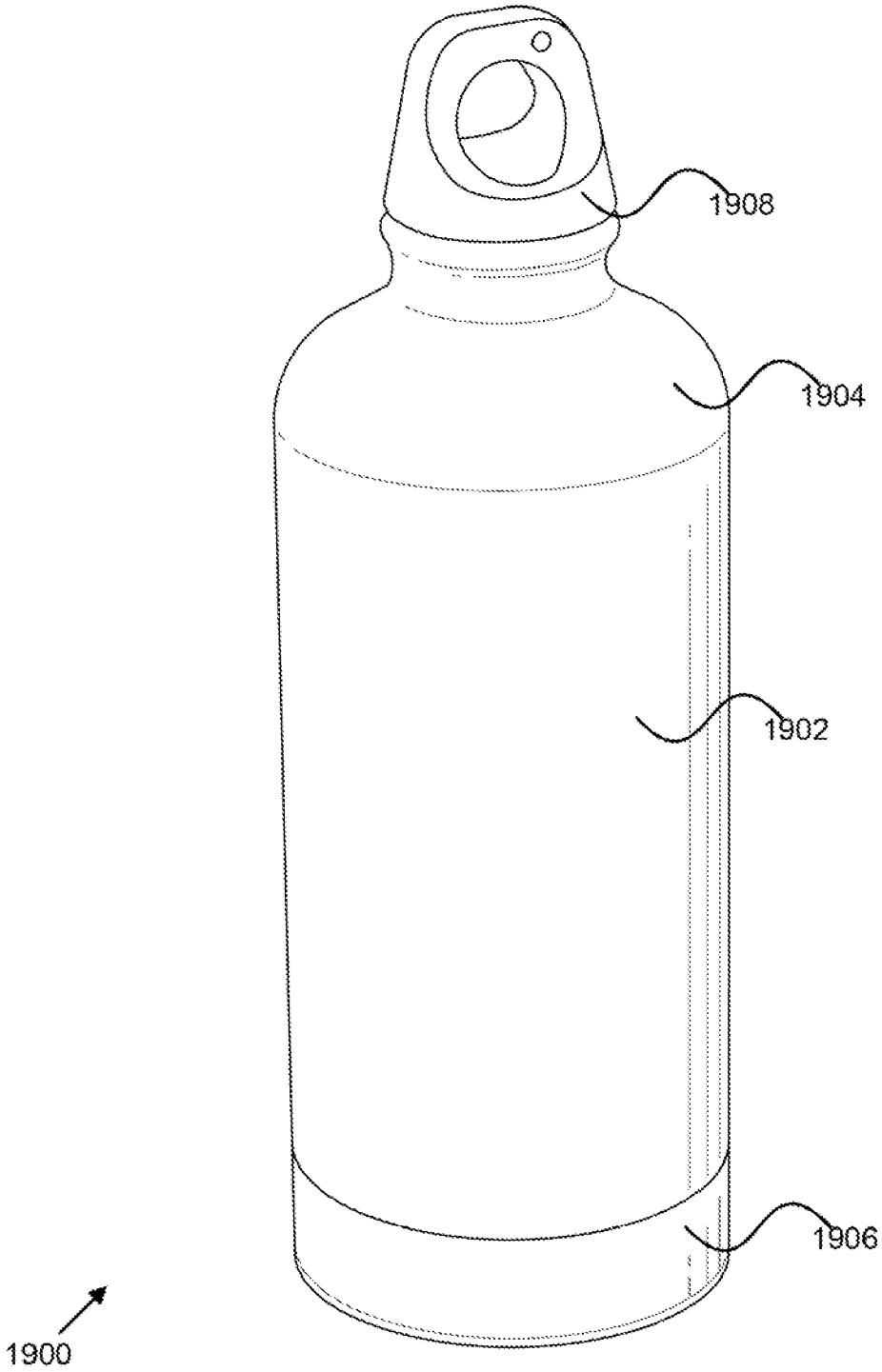
FIG. 25 illustrates an alternative exemplary hydration bottle.

FIG. 25 illustrates an alternative exemplary hydration bottle. Here, bottle 1900 includes body 1902, top cap 1904, bottom cap 1906, and plug 1908. In some examples, body 1902 and top cap 1904 may be formed as a single element. In other examples, body 1902 and top cap 1904 may be formed as separate elements. As shown, bottle 1900 may be used to store various types of liquids, fluids, or other materials. For example, bottle 1900 may be used to store flammable liquids such as gasoline, propane, liquid hydrogen, liquid oxygen, liquid nitrogen, and others, without limitation. In some examples, stored materials may leave a residue or residual materials, such as oils or other compounds and require cleaning. As shown, bottle 1900 may be difficult to completely clean from an aperture in which plug 1908 is inserted. However, by removing bottom cap 1906, which may have a sealing mechanism such as those shown and described above, complete access to the internal storage area of bottle 1900 may be gained. Different sizes, shapes, configurations, styles, appearances, or other structural, functional, aesthetic, or commercial aspects of bottle 1900 having top and bottom access may be varied and are not limited to the examples shown and described above.

Figure 26:
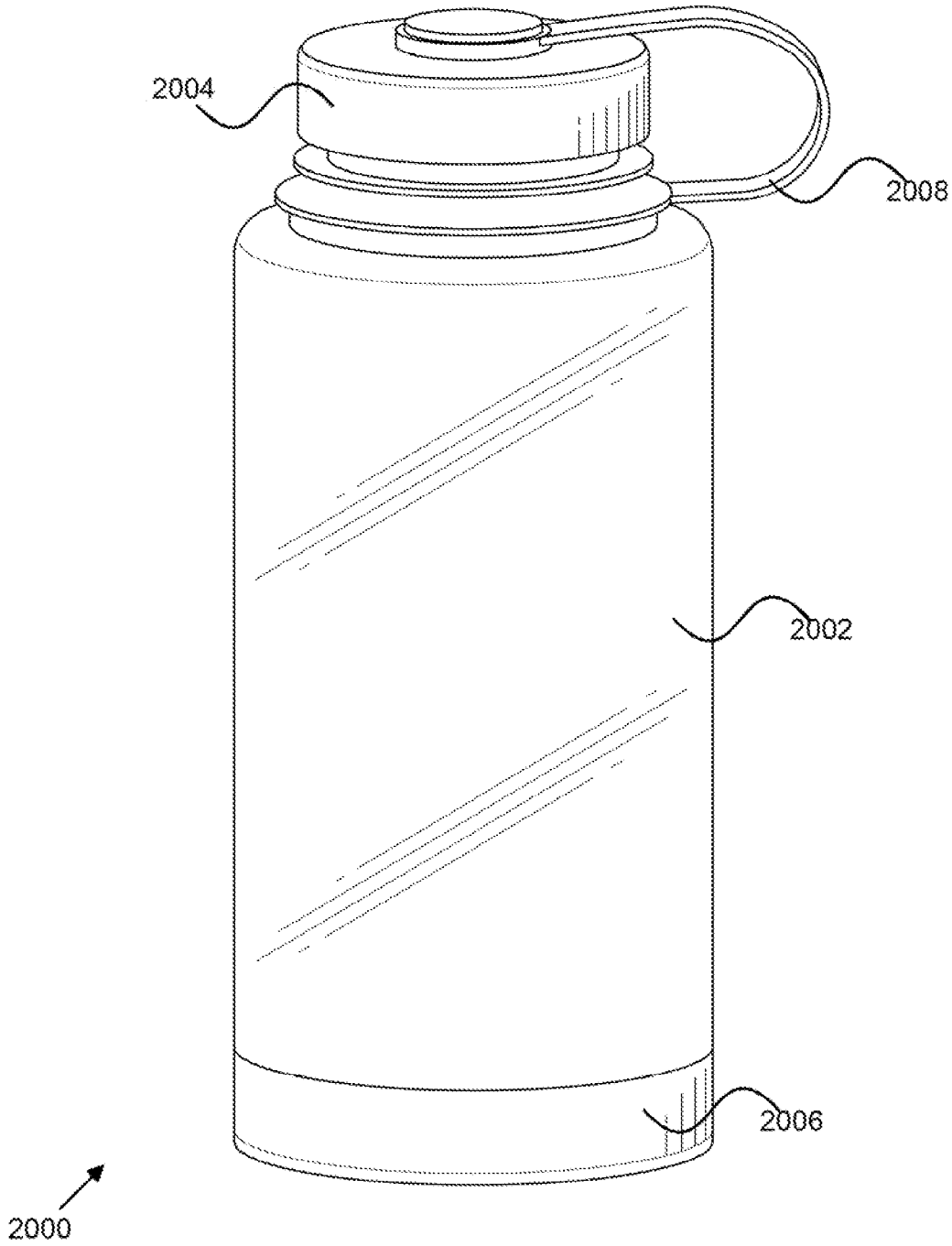
FIG. 26 illustrates another exemplary hydration bottle body.

FIG. 26 illustrates another exemplary hydration bottle body. Here, bottle 2000 includes body 2002, top cap 2004, bottom cap 2006, and lanyard 2008. In some examples, different materials such as high density plastics (HDPE), polycarbonates, polyester, copolyester, polyvinyl chloride (PVC), or other materials may be used to form bottle 2000. As an alternative example, bottle 2000 is shown with a wide necked opening (i.e., the diameter of top cap 2004 may be designed to be substantially similar in diameter to body 2002). However, a large bottle may be more comprehensively cleaned or otherwise accessed by having dual or double-ended access (i.e., having a bottom cap such as bottom cap 2006). Here, bottom cap 2006 may be provided to allow removal for entry into body 2002. In other examples, bottle 2000 may be varied in function, structure, operation, shape, design, configuration, implementation, or other aspects without limitation to the examples shown and described. Many other variations or alternative implementations of bottles having top and bottom caps such as those described herein are envisioned without limitation to any of the details or examples described herein.

Although the foregoing examples have been described in some detail for purposes of clarity of understanding, the invention is not limited to the details provided. There are many alternative ways of implementing the invention. The disclosed examples are illustrative and not restrictive.

What is claimed:

1. A container, comprising:

a body having a top neck molded at one end of the body and a bottom neck molded at another end of the body, the top neck, the bottom neck, and the body being formed using substantially similar material, wherein the top neck comprises a continuous screw thread formed externally and helically around a circumference of the top neck and the bottom neck comprises another continuous screw thread formed externally and helically around another circumference of the bottom neck;

a first cap comprising a channel configured to engage the continuous screw thread about the top neck, the first cap also comprising a nozzle shaft and a well configured to receive a nozzle body, the nozzle shaft and the well being a fabricated feature of the first cap;

a nozzle assembly comprising a nozzle, the nozzle body, a nozzle guide disposed on the nozzle body, a hole configured to receive the nozzle shaft and configured to prevent the separation of the nozzle assembly and the well, and one or more ridges formed circumferentially on the external surface of the nozzle body, the one or more ridges being configured to engage an inner surface of the well and to form a seal that, when the nozzle assembly is inserted into the well, is configured to direct fluid within the container through the hole in the nozzle when the nozzle assembly is disposed over the nozzle shaft; and a second cap comprising another channel configured to engage the another continuous screw thread, the second cap further comprising a canal formed along a bottom inner circumference of the second cap, the canal being configured to house a gasket and to provide a hermetic seal between a bottom lip of the bottom neck and the second cap when the another channel is engaged with the another continuous screw thread.

2. The container of claim 1, wherein the second cap is configured to permit access through the bottom neck to the body when the another channel is disengaged from the another continuous screw thread.

3. The container of claim 1, wherein the first cap and the second cap provide access at opposite ends of the body when the channel and the another channel are disengaged from the continuous screw thread and the another continuous screw thread, respectively.

4. The container of claim 1, wherein the canal further comprises an inner canal wall and an outer canal wall, the inner canal wall and the outer canal wall being configured to guide the bottom lip of the bottom neck to contact the upper surface of the gasket.

5. The container of claim 1, wherein the body is formed using plastic.

6. The container of claim 1, wherein the top neck and the bottom neck are substantially circular in shape.

7. The container of claim 1, wherein the first cap comprises another canal configured to house another gasket and to provide a hermetic seal between the top neck and the first cap.

8. The container of claim 1, wherein the body, the first cap, and the second cap are formed using low density plastic.

9. The container of claim 1, wherein the body, the first cap, and the second cap are formed using polyvinyl chloride.

10. The container of claim 1, wherein the body is formed using a material having a material memory.

11. The container of claim 1, wherein the body is formed using stainless steel.

12. The container of claim 1, wherein the gasket is formed using silicone.

13. The container of claim 1, wherein the gasket is formed using rubber.

14. The container of claim 1, wherein the first cap further comprises a side wall having a structure configured to facilitate gripping the first cap.

15. The container of claim 1, wherein the first cap further comprises a non-skid grip material.

* * * * *